US010906311B2

(12) United States Patent
Fukuzawa et al.

(10) Patent No.: US 10,906,311 B2
(45) Date of Patent: Feb. 2, 2021

(54) LIQUID EJECTING HEAD, LIQUID EJECTING APPARATUS, AND MANUFACTURING METHOD THEREOF

(71) Applicant: SEIKO EPSON CORPORATION, Tokyo (JP)

(72) Inventors: Yuma Fukuzawa, Matsumoto (JP); Motoki Takabe, Shiojiri (JP); Shunsuke Watanabe, Matsumoto (JP); Akira Miyagishi, Matsumoto (JP); Shunya Fukuda, Azumino (JP); Junichi Sano, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/452,951

(22) Filed: Jun. 26, 2019

(65) Prior Publication Data

US 2020/0001601 A1 Jan. 2, 2020

(30) Foreign Application Priority Data

Jun. 29, 2018 (JP) ..... 2018-124367

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1626* (2013.01); *B41J 2002/14491* (2013.01)

(58) Field of Classification Search
CPC ..... B41J 2/1433; B41J 2/162; B41J 2/1626
See application file for complete search history.

(56) References Cited

U.S. PATENT DOCUMENTS

| | | | | |
|---|---|---|---|---|
| 10,245,841 | B2 | 4/2019 | Asaka et al. | |
| 2006/0132543 | A1* | 6/2006 | Elrod | B41J 2/14233 347/49 |
| 2012/0176450 | A1 | 7/2012 | Akahane et al. | |
| 2016/0279930 | A1* | 9/2016 | Date | B41J 2/04541 |

(Continued)

FOREIGN PATENT DOCUMENTS

| | | |
|---|---|---|
| CN | 108025551 | 5/2018 |
| EP | 1671798 | 6/2006 |
| JP | 2012-143948 A | 8/2012 |

(Continued)

OTHER PUBLICATIONS

European Search Report issued in Application No. EP19182769 dated Nov. 12, 2019.

*Primary Examiner* — Jason S Uhlenhake
(74) *Attorney, Agent, or Firm* — Workman Nydegger

(57) ABSTRACT

A flow path formation substrate to which a nozzle plate is mounted includes a pressure chamber per nozzle, an individual supply path leading to the pressure chamber, an individual recovery path communicating with a flow channel near the nozzle. A conduction unit electrically coupled through a lead electrode to a pressure generator causing a pressure of the pressure chamber to vary is located at a position where the conduction unit overlaps with a flow path area of at least one individual flow path of the individual supply path or the individual recovery path in a plan view from a lamination direction in which the nozzle plate and the flow path formation substrate are laminated.

18 Claims, 15 Drawing Sheets

(56) References Cited

U.S. PATENT DOCUMENTS

| | | | |
|---|---|---|---|
| 2016/0297193 | A1 | 10/2016 | Yoshida |
| 2018/0257386 | A1 | 9/2018 | Asaka et al. |

FOREIGN PATENT DOCUMENTS

| | | |
|---|---|---|
| JP | 2017087708 | 5/2017 |
| WO | 2017047534 | 3/2017 |
| WO | 2018/123499 A | 5/2018 |

* cited by examiner

LIQUID EJECTING HEAD, LIQUID EJECTING APPARATUS, AND MANUFACTURING METHOD THEREOF

The present application is based on, and claims priority from JP Application Serial Number 2018-124367, filed Jun. 29, 2018, the disclosure of which is hereby incorporated by reference herein in its entirety.

BACKGROUND

1. Technical Field

The present disclosure relates to a liquid ejecting head, a liquid ejecting apparatus, and a manufacturing method thereof.

2. Related Art

A liquid ejecting apparatus ejecting a liquid from a nozzle is used as, for example, an ink jet type printing apparatus ejecting ink which is a liquid. In such a printing apparatus, since a viscosity increase and sedimentation of an ink ingredient lead to a deterioration of printing quality, techniques to circulate and supply ink to a pressure chamber that causes pressure variation of ink ejection are proposed (for example, JP-A-2012-143948). In JP-A-2012-143948, a pressure chamber per nozzle and ink supply/discharge flow paths to/from the pressure chamber are formed on a flow path formation substrate and a pressure generator and a wiring substrate electrically coupled to the pressure generator are laminated on the flow path formation substrate. Then, a wiring substrate is superimposed on a shared flow path area shared by a plurality of nozzles.

In the shared flow path area where the wiring substrate is disposed, a through hole penetrating a communication plate is closed by the flow path formation substrate, and a closing portion of the flow path formation substrate closing the through hole is set as a mounting place of the wiring substrate. Therefore, since a pressing load of the wiring substrate acts on the closing portion of the flow path formation substrate when the wiring substrate is mounted, there is a concern that the closing portion may be deformed to cause a deformation of a flow path shape of the shared flow path area. Since the deformation of the flow path shape affects how the ink flows in the shared flow path area, it is desirable to suppress or avoid the deformation of the flow path shape. It should be noted that such a phenomenon is not limited to an ink jet type printing apparatus but may occur also in other liquid ejecting apparatuses.

SUMMARY

According to an aspect of the present disclosure, there is provided a liquid ejecting head. The liquid ejecting head has a plurality of nozzles ejecting a liquid and includes a nozzle plate having a plurality of the nozzles; a flow path formation substrate having a shared supply path shared in liquid supply to the plurality of nozzles, an individual supply path branching off from the shared supply path and leading to a pressure chamber per nozzle, an individual recovery path through which the nozzle and the pressure chamber communicate with each other, and a shared recovery path into which the plurality of individual recovery paths merge and which is shared in liquid recovery from the plurality of nozzles; and a lead electrode electrically coupled to a pressure generator causing pressure of the pressure chamber to vary, in which a conduction unit contacting with the lead electrode and supplying a signal to the pressure generator through the lead electrode is located at a position where the conduction unit overlaps with a flow path area of at least one individual flow path of the individual supply path or the individual recovery path in a plan view from a lamination direction in which the nozzle plate and the flow path formation substrate are laminated.

DESCRIPTION OF EXEMPLARY EMBODIMENTS

First Embodiment

Figure 1:
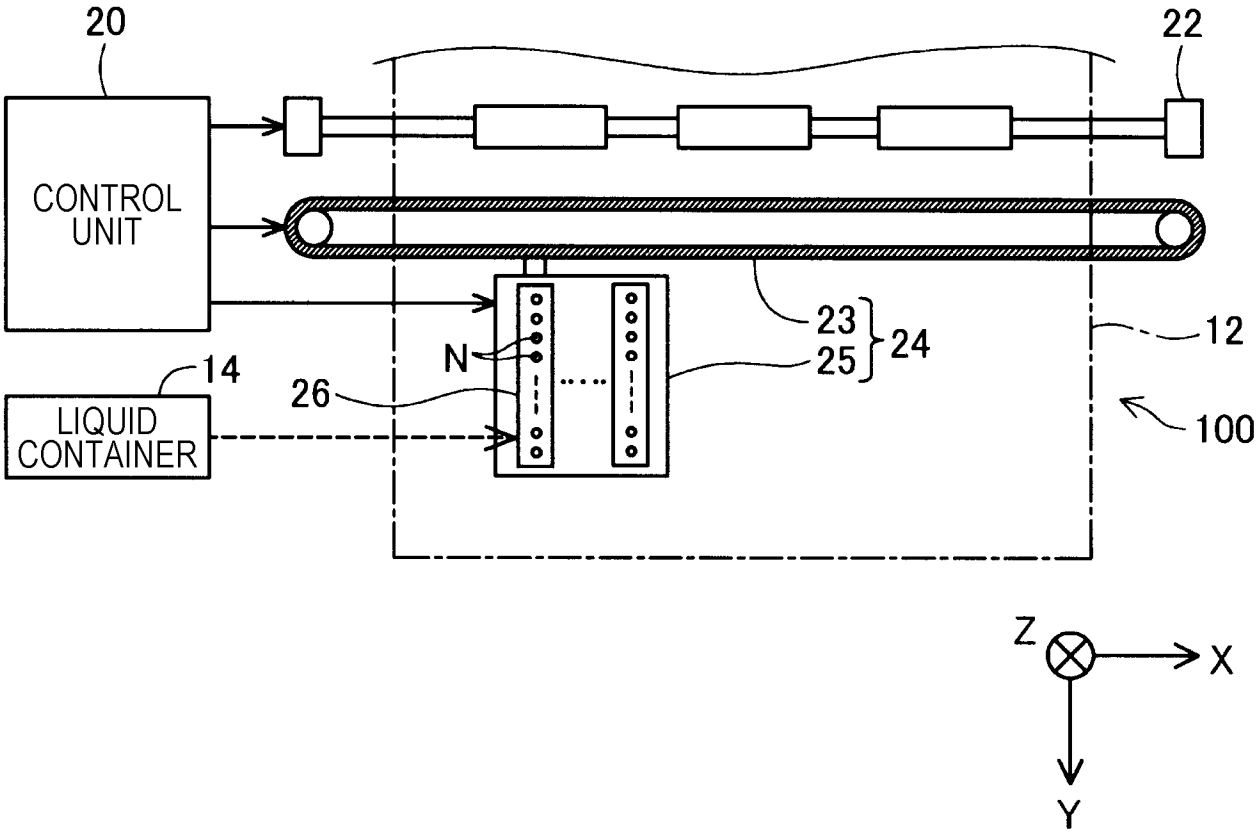
FIG. 1 is a schematic view illustrating a configuration of a liquid ejecting apparatus according to a first embodiment of the present disclosure.

FIG. 1 is a schematic view illustrating a configuration of a liquid ejecting apparatus 100 according to a first embodiment of the present disclosure. The liquid ejecting apparatus 100 is an ink jet type printing apparatus ejecting an ink droplet, an example of a liquid, onto a medium 12. In the following, ejection of an ink droplet will be simply referred to as an ejection. Using a printing target of any material such as a resin film or cloth in addition to a printing paper sheet as the medium 12, the liquid ejecting apparatus 100 performs printing on these various media 12. In FIG. 1 and each of the subsequent figures, out of the X-direction, Y-direction, and Z-direction, orthogonal to one another, a transport direction (main scanning axis) of a liquid ejecting head 26 to be described below will be referred to as X-direction, a medium feeding direction (sub-scanning axis) will be referred to as Y-direction, and an ink ejection direction will be referred to as Z-direction. Further, in the following description, for the sake of convenience of description, the main scanning axis will be referred to as a printing direction as deemed appropriate. Further, when a direction is specified, positive and negative signs will be used to denote a direction, + being attached to an indicated direction. The liquid ejecting direction may be a vertical direction or may be a direction intersecting with the vertical direction. The liquid ejecting apparatus 100 may be a so-called line printer in which the medium feeding direction (sub-scanning axis) coincides with the transport direction (main scanning axis) of the liquid ejecting head 26.

The liquid ejecting apparatus 100 includes a liquid container 14, a transport mechanism 22 that feeds the medium 12, a control unit 20, a head moving mechanism 24, and the liquid ejecting head 26. The liquid container 14 individually stores a plurality of types of ink to be ejected from the liquid ejecting head 26. A bag-shaped ink pack formed of a flexible film or a refillable ink tank may be used as the liquid container 14.

The control unit 20 includes a processing circuit such as a central processing unit (CPU), a field programmable gate array (FPGA), and the like and a memory circuit such as a semiconductor memory and controls the transport mechanism 22, the head moving mechanism 24, the liquid ejecting head 26 and the like. The transport mechanism 22 operates under the control of the control unit 20 and feeds the medium 12 in +Y-direction.

The head moving mechanism 24 includes a transport belt 23 wound over the printing range of the medium 12 in the X direction and a carriage 25 accommodating the liquid ejecting head 26 and fixing the liquid ejecting head 26 to the transport belt 23. The head moving mechanism 24 operates under the control of the control unit 20 and causes the liquid ejecting head 26 to reciprocate with the carriage 25 along the main scanning axis (X direction). At the time of reciprocation of the carriage 25, the carriage 25 is guided by a guide rail, but this guide rail is not illustrated. It should be noted that the head configuration may be such that the liquid container 14 is mounted on the carriage 25 together with the liquid ejecting head 26.

In the liquid ejecting head 26, the liquid container 14 is prepared for each ink color to be stored and the ink supplied from the liquid container 14 is ejected toward the medium 12 from a plurality of nozzles N under the control of the control unit 20. Printing of a desired image or the like is performed on the medium 12 by the ink ejection from the nozzle N during the reciprocation of the liquid ejecting head 26. As illustrated in FIG. 1, the liquid ejecting head 26 includes a nozzle row in which a plurality of the nozzles N are arranged along the sub-scanning axis.

Figure 2A:
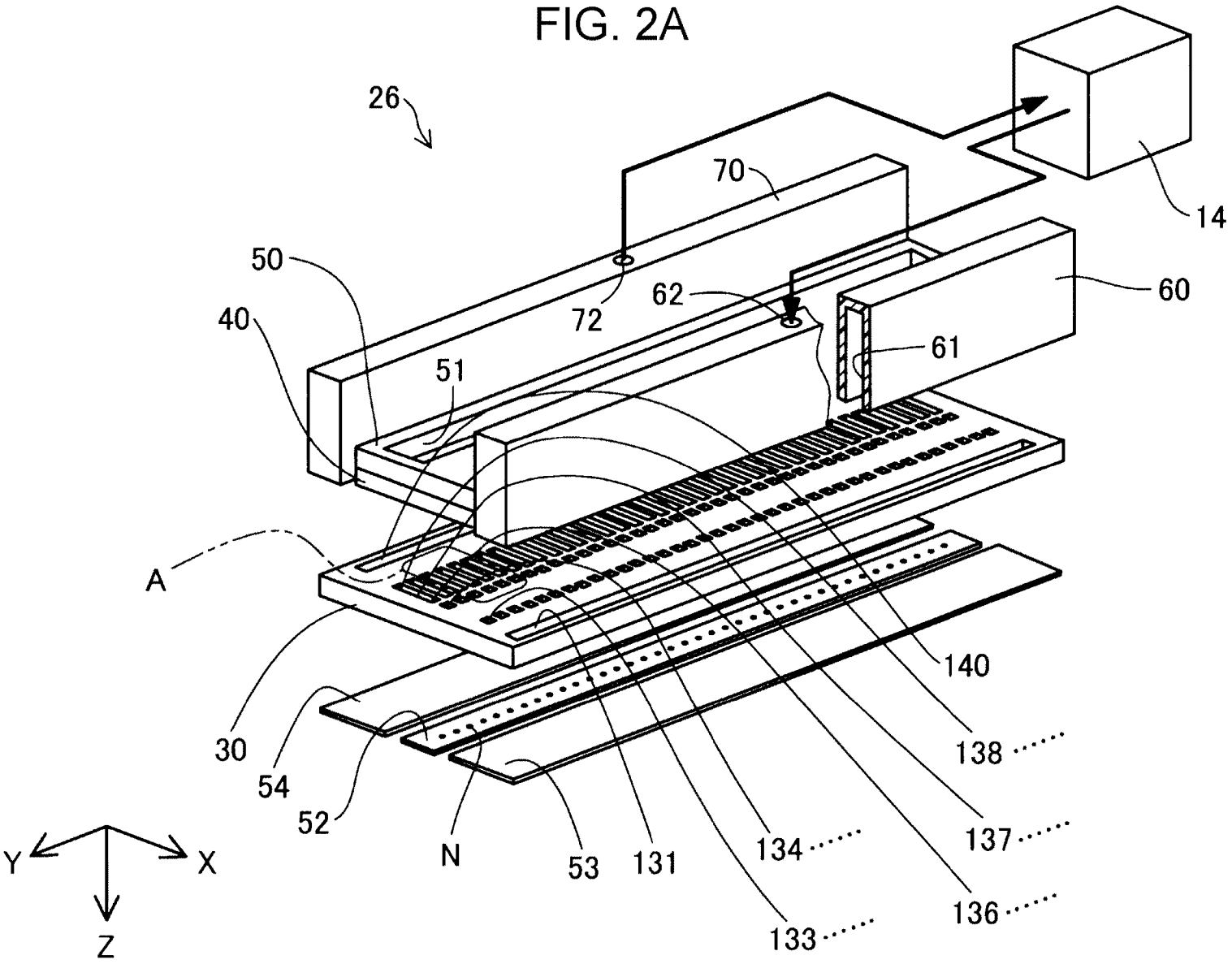
FIG. 2A is an exploded perspective view illustrating main head components of a liquid ejecting head seen from an upper side.
Figure 2B:
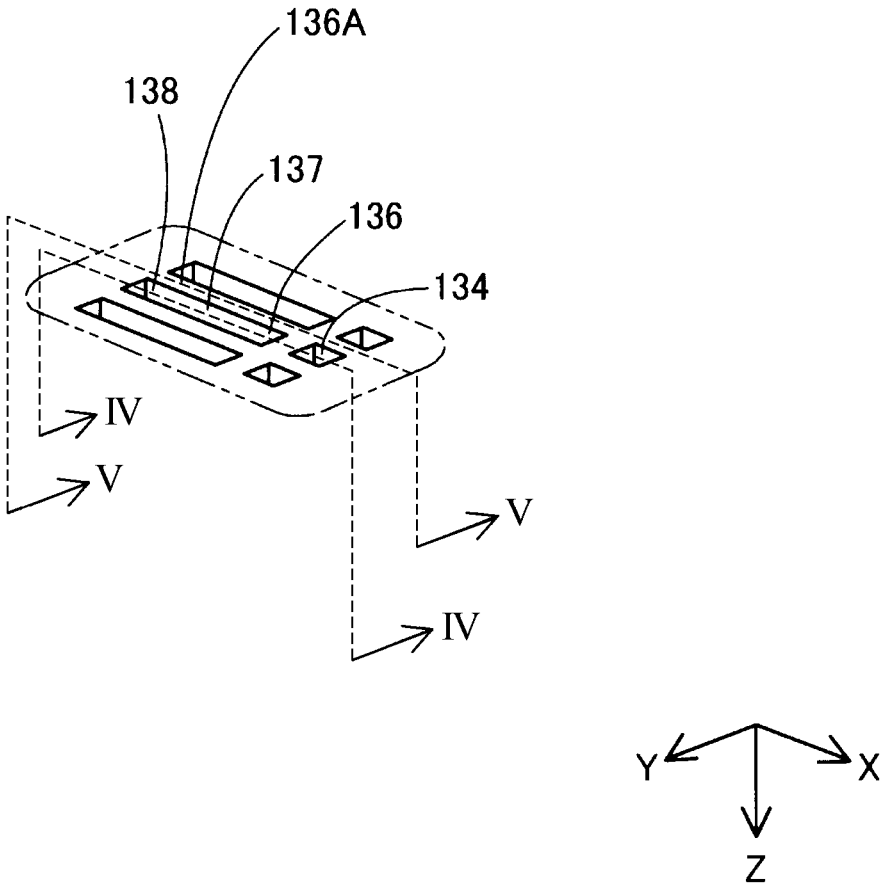
FIG. 2B is an enlarged sectional view illustrating a partial portion A of the head components in FIG. 2A.
Figure 3:
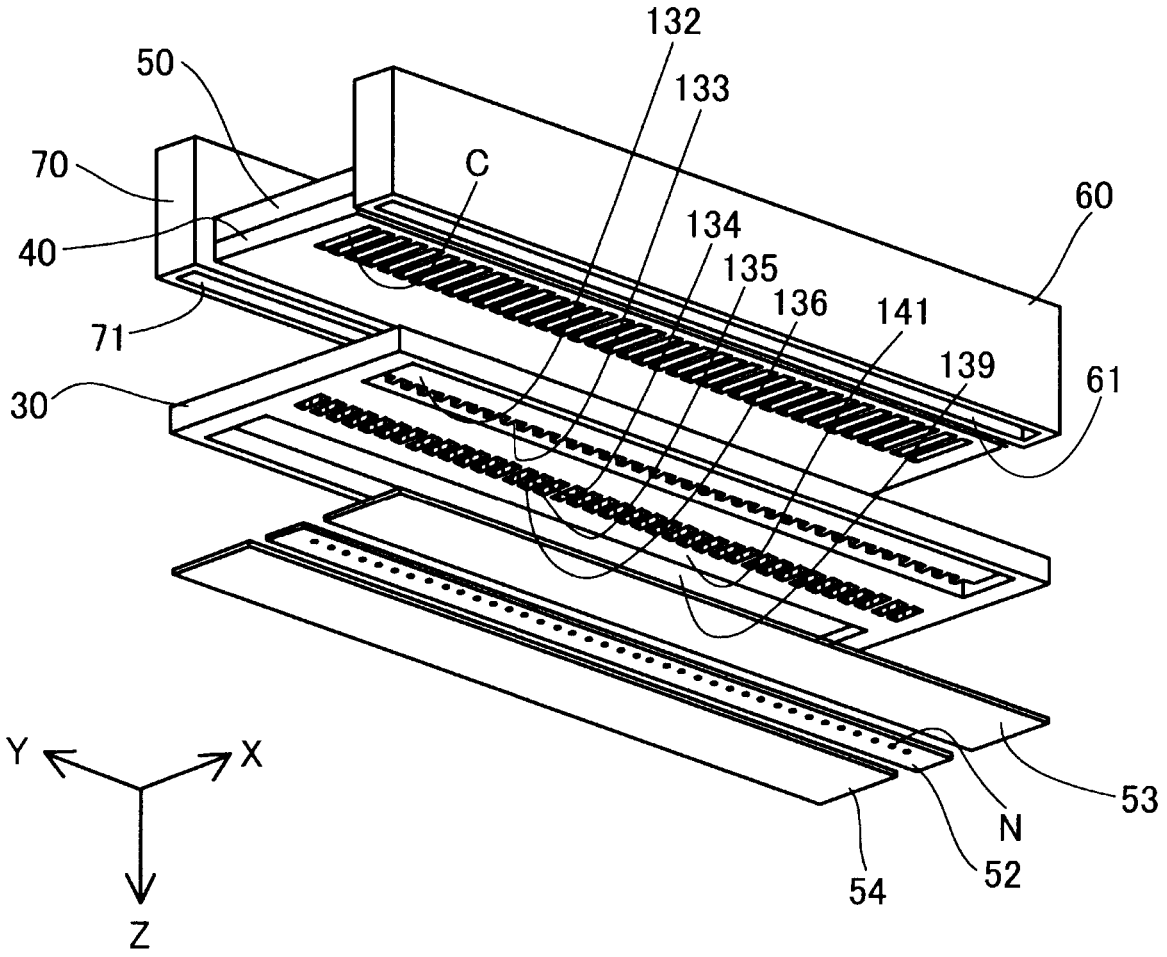
FIG. 3 is an exploded perspective view illustrating main head components of the liquid ejecting head seen from a lower side.
Figure 4:
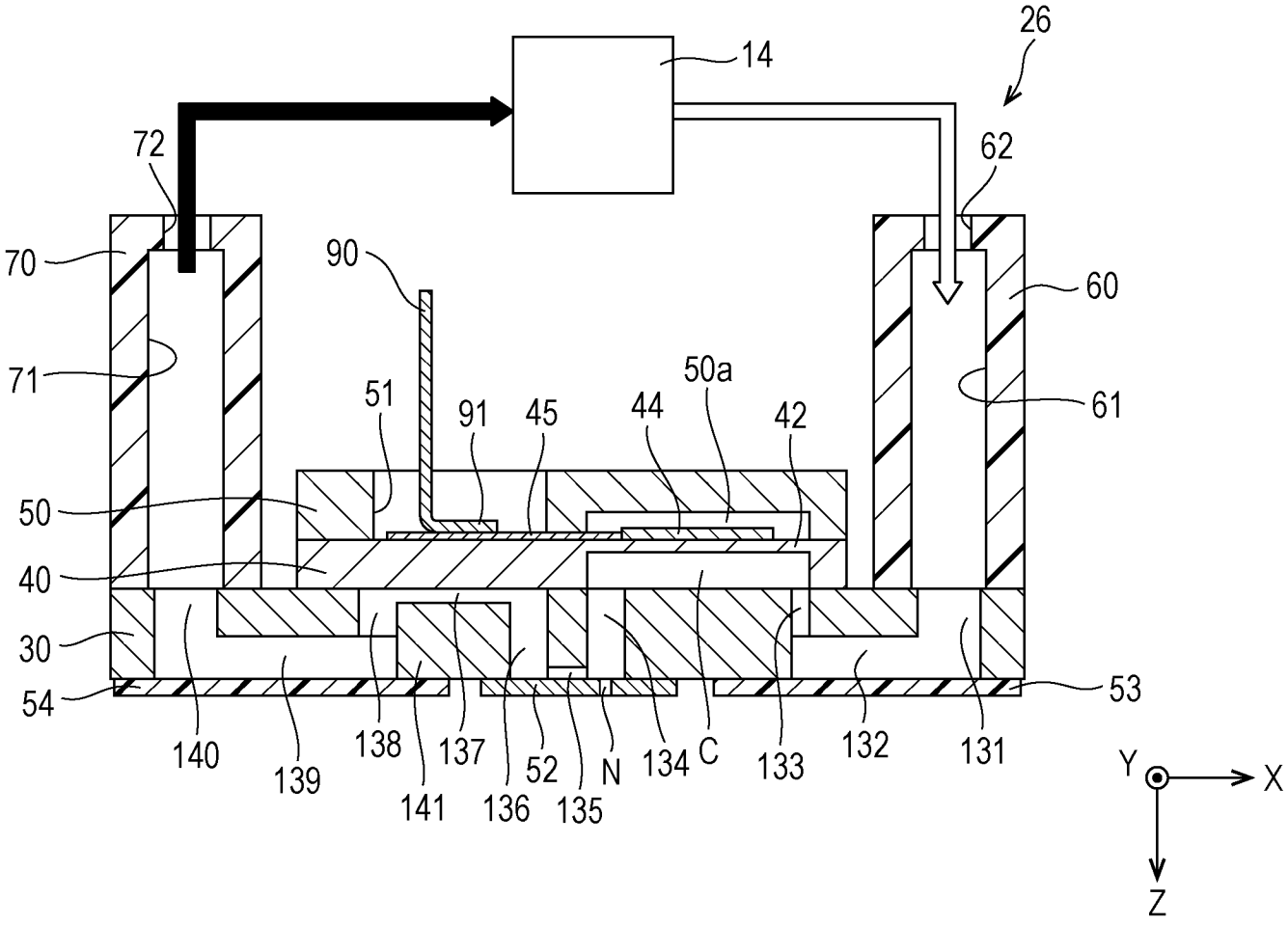
FIG. 4 is a sectional view illustrating the liquid ejecting head taken along line IV-IV in FIG. 2B.
Figure 5:
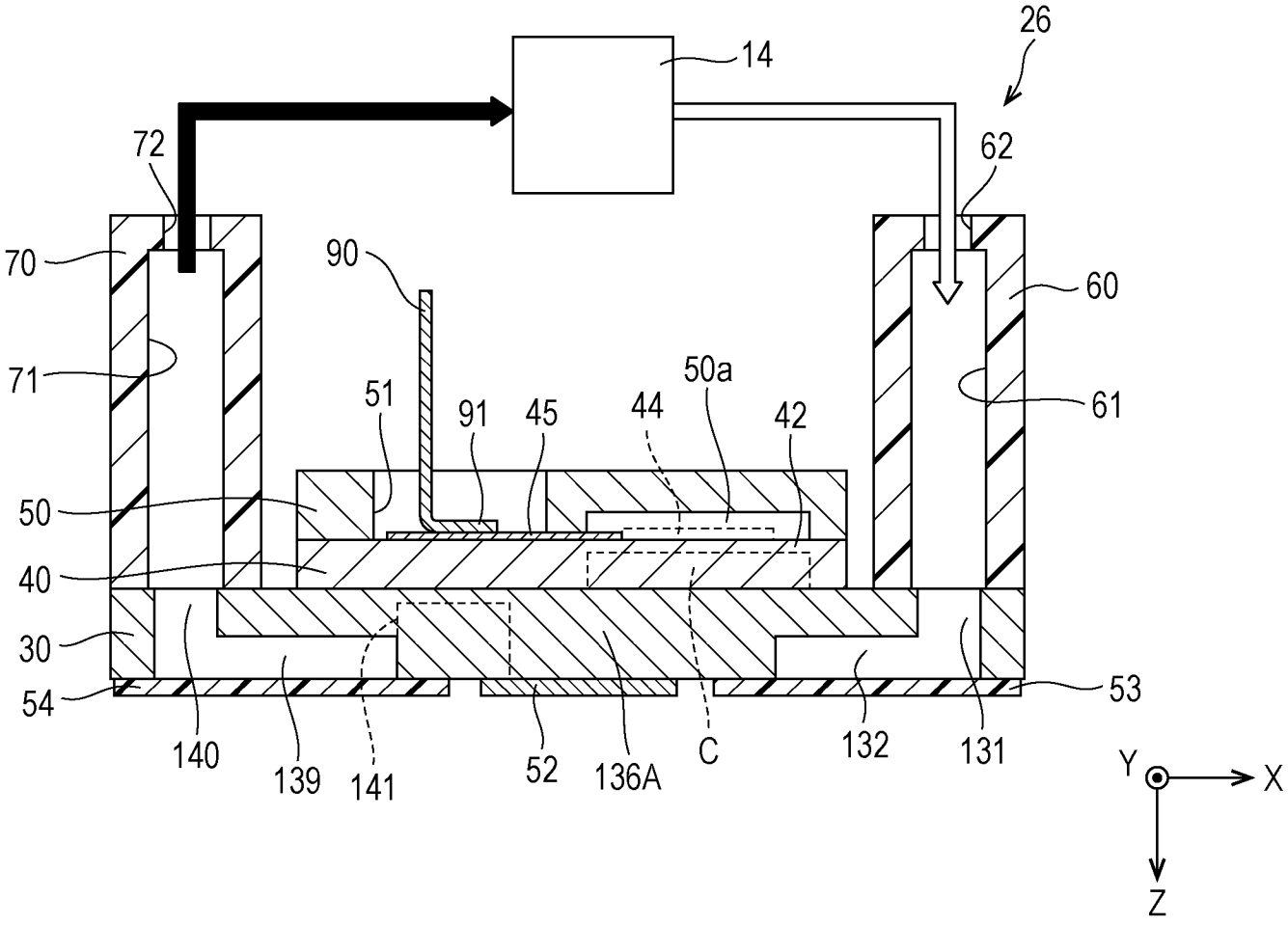
FIG. 5 is a sectional view illustrating the liquid ejecting head taken along line V-V in FIG. 2B.

The liquid ejecting head 26 is a laminate in which the head components are laminated in the Z direction. FIG. 2A is an exploded perspective view illustrating main head components of the liquid ejecting head 26 from an upper side. FIG. 2B is an enlarged sectional view illustrating a partial portion IIB of the head components in FIG. 2A. FIG. 3 is an exploded perspective view illustrating the main head components of the liquid ejecting head 26 from a lower side. FIG. 4 is a sectional view illustrating the liquid ejecting head 26 taken along line IV-IV in FIG. 2B. FIG. 5 is a sectional view illustrating the liquid ejecting head 26 taken along line V-V in FIG. 2B. It should be noted that the thickness of each configuration member illustrated does not represent the actual thickness of the component.

As illustrated in the drawings, the liquid ejecting head 26 includes, as the main head components, a flow path formation substrate 30 forming various flow paths to be described below in the head, a pressure chamber plate 40 forming a pressure chamber C per nozzle N, a pressure chamber side substrate 50 involved in the attachment and the protection of a piezoelectric element 44 to be described below as a pressure generator, a supply flow path substrate 60 for an ink supply, and a recovery flow path substrate 70 for an ink recovery. The supply flow path substrate 60 and the recovery flow path substrate 70 may be integrally formed or may be separately formed. Further, a supply side flexible plate 53 and a recovery side flexible plate 54 may be integrally formed or may be separately formed. The pressure generator may be a heat generating element that generates heat, may be an electrostatic element, or may be an MEMS element in order to cause pressure variation in the ink filled in the pressure chamber C.

The flow path formation substrate 30 is a plate body elongated in the Y direction from the X direction in a plan view from the Z direction, the supply flow path substrate 60 and the recovery flow path substrate 70 are mounted on the substrate upper surface in the Z direction, and the pressure chamber plate 40 and the pressure chamber side substrate 50 are mounted in a lamination state between the supply flow path substrate 60 and the recovery flow path substrate 70. Further, a nozzle plate 52, the supply side flexible plate 53, and the recovery side flexible plate 54 are mounted on the substrate lower surface of the flow path formation substrate 30 in +Z direction. Then, as described below, in the flow path formation substrate 30, various liquid flow paths are formed by a combination of the through holes and recessed grooves provided in the flow path formation substrate 30. The through hole may be a hole penetrating the flow path formation substrate 30 in the Z direction and the recessed groove may be a groove that does not penetrate the flow path formation substrate 30 in the Z direction. Further, by closing the recessed groove on the substrate lower surface with the nozzle plate 52, the supply side flexible plate 53, and the recovery side flexible plate 54, flow paths are formed between the flow path formation substrate 30, and the nozzle plate 52, the supply side flexible plate 53 and the recovery side flexible plate 54. In the following, each plate configuration will be described in relation to a flow path formation extending from the supply side to the recovery side of ink.

The supply flow path substrate 60 is a plate body elongated in the Y direction from the X direction in a plan view from the Z direction and includes an ink reception chamber 61 inside. The ink reception chamber 61 is formed as the recessed groove, of which a lower end is open and which extends in the Y direction, is closed by the flow path formation substrate 30, and receives the ink supplied from the liquid container 14 through the ink inlet 62 as indicated by a white arrow in FIG. 4.

From the mounting side of the supply flow path substrate 60 onward, the flow path formation substrate 30 has an ink inflow chamber 131, a supply liquid chamber 132, a supply flow path 133, a nozzle communication flow path 134, a recovery communication flow path 135, a first recovery flow path 136, a second recovery flow path 137, a third recovery flow path 138, an ink recovery chamber 139, and an ink discharge chamber 140.

As illustrated in FIG. 2A, the ink inflow chamber 131 is a rectangular through hole that penetrates the flow path formation substrate 30 in the Z direction and is elongated in the Y direction, and overlaps with the ink reception chamber 61 of the supply flow path substrate 60. The ink inflow chamber 131 may be polygonal or circular instead of being rectangular. As illustrated in FIGS. 3 and 4, the supply liquid chamber 132 is a rectangular recessed groove elongated in Y direction in succession to the ink inflow chamber 131 on the substrate lower surface of the flow path formation substrate 30 and is formed by the closing, over a flow path area, of the supply side flexible plate 53 mounted on the substrate lower surface of the flow path formation substrate 30. The supply liquid chamber 132 may be polygonal or circular instead of being rectangular. As illustrated in FIGS. 2A and 4, the supply flow path 133 is a through hole per nozzle N which penetrates the flow path formation substrate 30 in the Z direction and leads to the supply liquid chamber 132 and through which the pressure chamber C per nozzle N communicates with the supply liquid chamber 132 on one end side of the pressure chamber. As illustrated in FIGS. 2A and 4, the pressure chamber C is a recessed groove formed for each nozzle N on a lower surface of the pressure chamber plate 40 in the X direction and is formed by the mounting of the pressure chamber plate 40 on the substrate upper surface of the flow path formation substrate 30. The pressure chamber plate 40 may be interposed between the flow path formation substrate 30 and the pressure chamber side substrate 50, and the pressure chamber C may be a through hole penetrating the pressure chamber plate 40 in the Z direction. A mounting method will be described below.

As illustrated in FIG. 4, out of the supply flow paths for ink supply from the ink reception chamber 61 of the supply flow path substrate 60 to the pressure chamber C, the ink inflow chamber 131 and the supply liquid chamber 132 communicating therewith serve as a shared supply path shared in the ink supply (liquid supply) to a plurality of nozzles N and are closed by the supply side flexible plate 53 over the supply flow path area on the substrate lower surface of the flow path formation substrate 30. The supply side flexible plate 53 absorbs pressure variations in the ink inflow chamber 131 and the supply liquid chamber 132 and is formed of, for example, a flexible film, rubber, or thin film substrates or a compliance substrate containing them. The supply side flexible plate 53 may have elasticity. The supply flow path 133 is an individual supply flow path branching off from the shared supply path to each nozzle N and leading to the pressure chamber C per nozzle N. This supply flow path 133 is not illustrated in FIG. 5. This is because the supply flow paths 133 of the adjacent individual supply paths are partitioned for each nozzle N by the partition wall 136A in the flow path area, and FIG. 5 illustrates the partition wall 136A in a sectional view in the XZ plane.

As illustrated in FIGS. 2A and 4, the nozzle communication flow path 134 is a through hole which penetrates the flow path formation substrate 30 and through which the pressure chamber C and the nozzle N, on the other end side of the pressure chamber, of the nozzle plate 52 mounted on the substrate lower surface of the flow path formation substrate 30 communicate with each other for each nozzle. The nozzle N of the nozzle plate 52 is a circular through hole ejecting ink. The nozzle N may be a rectangular or polygonal through hole. The nozzle communication flow path 134 is not illustrated in FIG. 5. This is because the nozzle communication flow paths 134 of the adjacent individual recovery paths are partitioned by the partition wall 136A for each nozzle N in the flow path area, and FIG. 5 illustrates the partition wall 136A in a sectional view in the XZ plane. The nozzle plate 52 is liquid-tightly mounted on the substrate lower surface of the flow path formation substrate 30, closes the nozzle communication flow path 134 described above, the recovery communication flow path 135, and the first recovery flow path 136, to be described below, on the substrate lower end side of the flow path formation substrate 30, and positions the nozzle N at the lower end of the nozzle communication flow path 134.

As illustrated in FIGS. 3 and 4, the recovery communication flow path 135 is a rectangular recessed groove formed on the substrate lower surface of the flow path formation substrate 30 for each nozzle N and is formed by the liquid-tight closing of the nozzle plate 52 mounted on the substrate lower surface of the flow path formation substrate 30. The nozzle communication flow path 134 from the pressure chamber C and the first recovery flow path 136 penetrating the flow path formation substrate 30 in the Z direction communicate with each other through the recovery communication flow path 135 for each nozzle N. It should be noted that recovery communication flow path 135 may be polygonal or circular instead of being rectangular. The recovery communication flow path 135 and the first recovery flow path 136 are not illustrated in FIG. 5. This is because, like the supply flow path 133 and the nozzle communication flow path 134, the recovery communication flow paths 135 of the adjacent individual recovery paths are partitioned by the partition wall 136A in the flow path area thereof for each nozzle N, and the adjacent first recovery flow paths 136 are also partitioned by the partition wall 136A in the flow path area for each nozzle N. Then, FIG. 5 illustrates the partition wall 136A in a sectional view in the XZ plane. It should be noted that since the adjacent pressure chambers C are partitioned for each nozzle N even in the pressure chamber C in the pressure chamber plate 40, the pressure chamber C is not illustrated in FIG. 5 but is indicated by a dotted line for position identification thereof.

As illustrated in FIGS. 2A and 4, the second recovery flow path 137 is a rectangular recessed groove formed on the substrate upper surface of the flow path formation substrate 30 in succession to the first recovery flow path 136 for each nozzle N, and is formed by the liquid-tight closing of the pressure chamber plate 40 mounted on the substrate upper surface of the flow path formation substrate 30. The second recovery flow path 137 may be polygonal or circular instead of being rectangular. The third recovery flow path 138 penetrating the flow path formation substrate 30 in the Z direction and first recovery flow path 136 described above communicate with each other through the second recovery flow path 137 for each nozzle N and, as illustrated in FIGS. 3 and 4, a plate mounting seat 141 is formed on the substrate lower surface side of the flow path formation substrate 30. The plate mounting seat 141 serves as a mounting seat for the nozzle plate 52 and the recovery side flexible plate 54. The second recovery flow path 137 and the third recovery flow path 138 are not illustrated in FIG. 5. This is because, like the supply flow path 133 and the nozzle communication flow path 134 described above, the second recovery flow paths 137 of the adjacent individual recovery paths are partitioned by the partition wall 136A in the flow path area for each nozzle N, and the third recovery flow paths 138 of the adjacent individual recovery paths are also partitioned by the partition wall 136A in the flow path area for each nozzle N. Then, FIG. 5 illustrates the partition wall 136A in a sectional view in the XZ plane. It should be noted that since the plate mounting seat 141 occupies a part of the area of the partition wall 136A illustrated in FIG. 5, the plate mounting seat 141 is indicated by a dotted line in FIG. 5.

The recovery flow path substrate 70 is a plate body elongated in Y direction rather than in X direction in a plan view from the Z direction and includes an ink accommodation chamber 71 inside. Like the ink reception chamber 61 of the supply flow path substrate 60 described above, the ink accommodation chamber 71 is formed as a recessed groove, of which the lower end is open and which extends in the Y direction, and is closed by the flow path formation substrate 30, and, as indicated by a black arrow in FIG. 4, the ink discharged from the ink discharge chamber 140 to be described below is circulated back to the liquid container 14 through an ink outlet 72. It should be noted that the ink circulation from the recovery flow path substrate 70 is performed by an ink recovery mechanism (not shown).

As illustrated in FIG. 2A, the ink discharge chamber 140 of the flow path formation substrate 30 is a rectangular through hole elongated in the Y direction penetrating the flow path formation substrate 30 in the Z direction and overlaps with the ink accommodation chamber 71 of the recovery flow path substrate 70. The ink discharge chamber 140 may be polygonal or circular instead of being rectangular. As illustrated in FIGS. 3 and 4, the ink recovery chamber 139 is a rectangular groove elongated in the Y direction on the substrate lower surface of the flow path formation substrate 30, communicates with the ink discharge chamber 140 in the Y direction, the lengthwise direction thereof, and is formed by the closing, over the flow path area, of the recovery side flexible plate 54 mounted on the substrate lower surface of the flow path formation substrate 30. The ink recovery chamber 139 may be polygonal or circular instead of being rectangular. Then, the third recovery flow path 138 per nozzle N merges into the ink recovery chamber 139, and the third recovery flow path 138 per nozzle N and the ink discharge chamber 140 communicate with each other through the ink recovery chamber 139.

Out of the recovery flow paths for recovering the ink passing through the pressure chamber C, the ink discharge chamber 140 and the ink recovery chamber 139 communicating therewith serve as the shared recovery paths shared in the ink recovery (liquid recovery) from a plurality of nozzles N and are closed, over the flow path area on the substrate lower surface of the flow path formation substrate 30, by the recovery side flexible plate 54. The nozzle communication flow path 134, the recovery communication flow path 135, the first recovery flow path 136, the second recovery flow path 137, and the third recovery flow path 138 are individual recovery paths per nozzle N. Like the supply side flexible plate 53, the recovery side flexible plate 54 absorbs pressure variations in the ink recovery chamber 139 and the discharge chamber 140 and is made of, for example, a flexible film, rubber, or thin film substrate, or a compliance substrate containing these. The recovery side flexible plate 54 may preferably have elasticity.

The pressure chamber side substrate 50 holds the pressure chamber plate 40 on the substrate upper surface of the flow path formation substrate 30. A lead electrode 45 for conducting the piezoelectric element 44 of each pressure chamber C is provided on the substrate upper surface of the pressure chamber plate 40. The pressure chamber side substrate 50 may hold the lead electrode 45 against the pressure chamber plate 40. As illustrated in FIG. 2A, the pressure chamber side substrate 50 is a plate body elongated in the Y direction rather than X direction in the plan view from the Z direction and covers the diaphragm 42 along with the piezoelectric element 44 with a covered recessed groove 50*a* of the recessed groove long in the Y direction in the plan view from the Z direction. The covered recessed groove 50*a* may be provided for each piezoelectric element 44. Further, the pressure chamber side substrate 50 has a rectangular through hole 51 elongated in the Y direction in the plan view from the Z direction for the installation of the wiring substrate 90 electrically contacting with the lead electrode 45. The rectangular through hole 51 may be polygonal or circular instead of being rectangular.

The diaphragm 42 is a ceiling wall of the pressure chamber C formed in a thin plate shape configured to vibrate elastically and includes a piezoelectric element 44 for each pressure chamber C. The diaphragm 42 may be integrated with the pressure chamber plate 40, or may be a separate body therefrom. Each piezoelectric element 44 is a passive element that individually corresponds to the nozzle N and deforms upon receiving the drive signal from the control unit 20 and is disposed in the diaphragm 42 in association with the arrangement of the nozzle N. By the vibration of the piezoelectric element 44, a pressure variation is caused in the ink already supplied to the pressure chamber C. The pressure variation reaches the nozzle N through the nozzle communication flow path 134. The piezoelectric element 44 includes the two electrode layers provided on the substrate upper surface of the pressure chamber plate 40 and a piezoelectric layer interposed between the two electrode layers in the Z direction.

A wiring substrate 90 is, for example, a flexible substrate mounted with a drive circuit configured with a drive IC and is mounted in the rectangular through hole 51 such that a coupling portion 91 at the substrate tip contacts with the lead electrode 45. The coupling portion 91 contacts with the lead electrode 45 in the Z direction. The electrode 45 is electrically coupled to the electrode layer of the piezoelectric element 44. The lead electrode 45 may be an electrode drawn from the electrode layer of the piezoelectric element 44 in the in-plane direction of the XY plane. It should be noted that the coupling portion 91 may directly contacts with the lead electrode 45, or may indirectly contact with the lead electrode 45 through, for example, a conductive adhesive. The wiring substrate 90 thus mounted is electrically coupled to the piezoelectric element 44 through the lead electrode 45 and supplies the signal from the drive circuit from the control unit 20 to each of the piezoelectric elements 44 through the lead electrode 45. Therefore, the wiring substrate 90 constitutes an embodiment of the conduction unit according to an aspect of the present disclosure. Mounting of the wiring substrate 90 is performed by using an appropriate adhesive such as conductive adhesive or non-conductive adhesive such that the electrical coupling of the coupling portion 91 and the lead electrode 45 is maintained.

Together with the wiring substrate 90, the pressure chamber side substrate 50 holds the pressure chamber plate 40 from the opposite side to the nozzle plate 52 and is mounted to the flow path formation substrate 30. As illustrated in FIG. 4, in the mounting state, the rectangular through hole 51, which is the location where the wiring substrate 90 is provided, overlaps with the first recovery flow path 136, the second recovery flow path 137, and the third recovery flow path 138 which are individual recovery paths in the flow path formation substrate 30. In the present embodiment, the coupling portion 91 of the wiring substrate 90 is made shorter than the flow path length of the individual recovery path extending from the first recovery flow path 136 to the third recovery flow path 138. Therefore, the wiring substrate 90 overlaps with the flow path area of the second recovery flow path 137, which serves as a part of the individual recovery path, at the coupling portion 91. It should be noted that the wiring substrate 90 may be of a size to overlap with the flow path area extending from the first recovery flow path 136 to the third recovery flow path 138.

Figure 6:
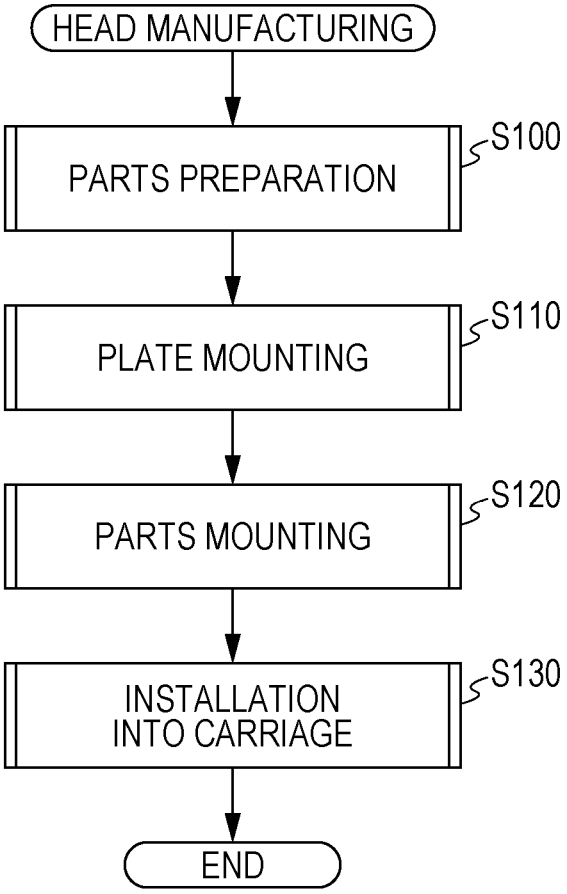
FIG. 6 is a flowchart illustrating a manufacturing process of a liquid ejecting head provided in the liquid ejecting apparatus.

FIG. 6 is a flowchart illustrating a manufacturing process of a liquid ejecting head 26 provided in the liquid ejecting apparatus 100. In obtaining the liquid ejecting head 26, first, constituting parts are respectively prepared (step S100). The parts to be prepared are the flow path formation substrate 30, the pressure chamber plate 40, the pressure chamber side substrate 50, the nozzle plate 52, the supply side flexible plate 53, recovery side flexible plate 54, supply flow path substrate 60, recovery flow path substrate 70, and the wiring substrate 90 described above, and a manufacturing method of each part is used in the parts preparation.

A semiconductor manufacturing technique for a single crystal substrate of silicon (Si), for example, a processing technique such as dry etching or wet etching, is applied to the preparation such that the flow path formation substrate 30 is formed to have a flow path from the ink inflow chamber 131 to the ink discharge chamber 140 described above. Like the flow path formation substrate 30, the semiconductor manufacturing technique, described above, for a single crystal substrate of silicon is applied such that the pressure chamber plate 40 is formed to have the pressure chamber C and the diaphragm 42 that hits the ceiling thereof. Next, the piezoelectric element 44 and the lead electrode 45 are mounted so as to correspond to each pressure chamber C, and in this way, the pressure chamber plate 40 is prepared. Like the flow path formation substrate 30, the semiconductor manufacturing technique, described above, for a single crystal substrate of silicon is applied to the preparation such that the pressure chamber side substrate 50 is formed to have a covered recessed groove 50*a* and the rectangular through hole 51. It should be noted that, for these parts, a substrate made of another material such as a metal or glass may be used instead of a single crystal substrate of silicon.

Like the flow path formation substrate 30, the semiconductor manufacturing method for a single crystal substrate of silicon (Si) is applied to the preparation such that the nozzle plate 52 is formed to have nozzles N in a row shape. It should be noted that a substrate made of other materials such as a metal or glass may be used instead of the single crystal substrate of silicon. The supply side flexible plate 53 and the recovery side flexible plate 54 are prepared by the cutting of a flexible film or the like into a rectangular shape. The supply flow path substrate 60 and the recovery flow path substrate 70 are prepared by the injection molding of an appropriate resin material so as to have the ink reception chamber 61 with the ink inlet 62 and the ink accommodation chamber 71 with the ink outlet 72. The wiring substrate 90 is prepared as a substrate such as COF which is a flexible wiring having a drive circuit (not shown), and has a contact point with the lead electrode 45 on the lower surface of the coupling portion 91.

Following the parts preparation, plate mounting is performed in a clean room (step S110). In the plate mounting, the nozzle plate 52, the supply side flexible plate 53, and the recovery side flexible plate 54 are mounted on the substrate lower surface of the flow path formation substrate 30. In the plate mounting, the nozzle plate 52 is mounted over the plate mounting seat 141 such that the nozzle N overlaps with the nozzle communication flow path 134 of the flow path formation substrate 30 and the nozzle communication flow path 134 and the first recovery flow path 136 are closed on the substrate lower surface of the flow path formation substrate 30. The supply side flexible plate 53 is mounted such that the flow path area of the ink inflow chamber 131 and the supply liquid chamber 132 are closed on the substrate lower surface of the flow path formation substrate 30. The recovery side flexible plate 54 is mounted such that the flow path area of the ink recovery chamber 139 with which the third recovery flow path 138 communicates and the ink discharge chamber 140 in succession to the ink recovery chamber 139 are closed on the substrate lower surface of the flow path formation substrate 30. Mounting of the nozzle plate 52 or the like to the flow path formation substrate 30 is liquid-tightly performed by using an appropriate adhesive.

Following the plate mounting, various parts mounting is performed (step S120) in a workshop of a normal environment. In the plate mounting, the mounting of the pressure chamber side substrate 50 for holding the pressure chamber plate 40, the mounting of the supply flow path substrate 60 and the recovery flow path substrate 70, and the mounting of the wiring substrate 90 are performed. The mounting of the pressure chamber side substrate 50 and the mounting of both the flow path substrates may be performed in reverse or simultaneously. On the other hand, the mounting of the wiring substrate 90 is performed after the mounting of the pressure chamber side substrate 50. It should be noted that the parts mounting may be performed in a clean room, and the order of the plate mounting and the parts mounting may be switched. For example, the mounting of the supply side flexible plate 53 and the recovery side flexible plate 54 may be performed after the mounting of the pressure chamber side substrate 50.

When the pressure chamber side substrate 50 is mounted to the flow path formation substrate 30, in a state where the piezoelectric element 44 of the pressure chamber plate 40 overlaps with the pressure chamber C, the pressure chamber side substrate 50 is mounted to the flow path formation substrate 30 from the opposite side to the nozzle plate 52 such that the pressure chamber C overlaps with the supply flow path 133 of the flow path formation substrate 30 and the nozzle communication flow path 134 on the pressure chamber end portion side. The supply flow path substrate 60 and the recovery flow path substrate 70 are mounted on the flow path formation substrate 30 such that the ink reception chamber 61 overlaps with the ink inflow chamber 131 of the flow path formation substrate 30 and the ink accommodation chamber 71 overlaps with the ink discharge chamber 140 of the flow path formation substrate 30. The holding and mounting of the pressure chamber plate 40 on the flow path formation substrate 30 by the pressure chamber side substrate 50 and the mounting of the supply flow path substrate 60 and the recovery flow path substrate 70 on the flow path formation substrate 30 may be liquid-tightly performed by using an appropriate adhesive.

The wiring substrate 90 is pressed such that the coupling portion 91 is electrically coupled to the lead electrode 45 positioned at a bottom portion of the rectangular through hole 51 and is mounted by using an appropriate adhesive while maintaining the state of being pressed. In this way, the liquid ejecting head 26 is obtained. In the following, "mounting" and "fixing" are expressed in the same meaning.

Following the parts mounting, installation into a carriage is performed (step S130), in which the obtained liquid ejecting head 26 is installed into the carriage 25 (refer to FIG. 1) in a workshop of a normal environment. In the installation into carriage, in addition to the installation of the liquid ejecting head 26 into a predetermined position of the carriage 25, a flow path coupling between the supply flow path substrate 60 and the liquid container 14 and a flow path coupling of the recovery flow path substrate 70 and the liquid container 14 are performed.

In the liquid ejecting head 26 having the flow path configuration described above, the ink supplied from the liquid container 14 by a pump (not shown) flows into the ink inflow chamber 131 and the supply liquid chamber 132 of the flow path formation substrate 30 through the ink reception chamber 61 in the supply flow path substrate 60 and fills the inflow chamber 131 and the supply liquid chamber 132 serving as the shared supply paths. The ink filled in this way is pushed out by the ink continuously supplied and is supplied to the pressure chamber C through the supply flow path 133 serving as the individual flow path per nozzle N, and, in the pressure chamber C, the ink, subjected to the vibrations of the piezoelectric element 44 drive-controlled by the control unit 20, is ejected from the nozzle N. The ink supply from the liquid container 14 continues in a printing situation where the ink ejection from the nozzle N is performed as well as in the condition where the ink ejection from the nozzle N is not performed. In the plurality of pressure chambers C, the ink is individually supplied through the supply flow path 133 that branches off to each nozzle from the ink inflow chamber 131 and the supply liquid chamber 132 shared by the plurality of nozzles N.

In the situation where the ink supply to the pressure chamber C continues, the ink not ejected from the nozzle N passes through each pressure chamber C and then is pushed out to the ink recovery chamber 139 and the ink discharge chamber 140 shared by the plurality of nozzles N through the recovery communication flow path 135, the first recovery flow path 136, and the third recovery flow path 138 of each pressure chamber C and is discharged to the ink accommodation chamber 71 of the recovery flow path substrate 70. Thereafter, the ink circulates back to the liquid container 14.

In the liquid ejecting apparatus 100 according to the first embodiment described above, the wiring substrate 90 electrically coupled to the piezoelectric element 44 per nozzle N through the lead electrode 45 is mounted such that the coupling portion 91 exerting the load at the time of mounting overlaps with the flow path area of the second recovery flow path 137 serving as a part of the individual recovery path of the flow path formation substrate 30. Through the recovery communication flow path 135 and the first recovery flow path 136 per nozzle N, the second recovery flow path 137 communicates with the nozzle communication flow path 134 per nozzle N, through which the nozzle N and the pressure chamber C communicate with each other. Therefore, as illustrated in FIGS. 4 and 5, the individual recovery paths of the second recovery flow path 137, the recovery communication flow path 135 and the first recovery flow path 136 are partitioned from the adjacent individual recovery paths by the partition wall 136A in the flow path area thereof. As a result, in the liquid ejecting apparatus 100 according to the first embodiment, since the pressing load when the wiring substrate 90 is electrically coupled to the piezoelectric element 44 through the lead electrode 45 can be received by the partition wall 136A in the individual recovery path described above, the shape of the flow path extending from the recovery communication flow path 135 to the second recovery flow path 137 may not be deformed, or it is possible to suppress or avoid the deformation thereof. Further, in the liquid ejecting apparatus 100 according to the first embodiment, since the electric coupling of the lead electrode 45 to the coupling portion 91 in a state where the pressing load is received by the partition wall is possible, it is possible to securely perform the electrical coupling.

In the liquid ejecting apparatus 100 according to the first embodiment, the length of the coupling portion 91 of the wiring substrate 90 is shorter, in the plan view from the Z direction, than the flow path length of the individual recovery path extending from the first recovery flow path 136 to the third recovery flow path 138. Therefore, since the pressing load when the wiring substrate 90 is mounted applies only to the flow path area of the second recovery flow path 137 serving as a part of the individual recovery path in the liquid ejecting apparatus 100 according to the first embodiment, the pressing load of the wiring substrate 90 can be more securely received by the partition walls 136A in the adjacent second recovery flow paths 137. As a result, it is possible to securely suppress or avoid the deformation of the flow path shape of the second recovery flow path 137 in the liquid ejecting apparatus 100 according to the first embodiment.

The coupling portion 91 of the wiring substrate 90 contacting with the lead electrode 45 overlaps with the flow path area of the second recovery flow path 137 serving as an individual flow path in the plan view from the lamination direction in the liquid ejecting apparatus 100 according to the first embodiment. Then, in the lamination direction, the depth of the flow path area of the second recovery flow path 137 overlapping with the coupling portion 91 is equal to or less than half the distance between the nozzle plate 52 and the coupling portion 91. Therefore, the strength of the second recovery flow path 137 that receives the pressing load is easily secured.

According to the first embodiment, the liquid ejecting apparatus 100 supplies the ink from the supply flow path extending from the ink inflow chamber 131 to the supply flow path 133 to the pressure chamber C per nozzle N and recovers the ink that passes through the pressure chamber C per nozzle N and that is not ejected from the nozzle N in the recovery flow path extending from the recovery communication flow path 135 to the ink discharge chamber 140. During the supply and recovery of ink, the ink to be supplied to the pressure chamber C fills the ink inflow chamber 131 and the supply liquid chamber 132 serving as shared supply paths out of the supply flow paths, and the ink that passes through the pressure chamber C fills the ink recovery chamber 139 and the ink discharge chamber 140 serving as the shared recovery paths out of the recovery flow paths. The ink inflow chamber 131 and the supply liquid chamber 132 constituting the shared supply paths are closed by the supply side flexible plate 53 over the flow path area, and the ink recovery chamber 139 and the ink discharge chamber 140 constituting the shared recovery paths are closed by the recovery side flexible plate 54 over the flow path area. Therefore, the variation of the ink supply pressure applied to the ink that fills the ink inflow chamber 131 and the supply liquid chamber 132 is damped by the flexing of the supply side flexible plate 53. Further, the variation of the ink supply pressure applied to the ink that fills the ink recovery chamber 139 and the ink discharge chamber 140 is damped by the flexing of the recovery side flexible plate 54. As a result, it is possible to reduce the impact of the ink ejection pressure of the ink ejected just previously on the ink ejection pressure at the time of new ink ejection in the liquid ejecting apparatus 100 according to the first embodiment.

According to the first embodiment, the liquid ejecting apparatus 100 is provided with the ink inflow chamber 131 and the supply liquid chamber 132 of the shared supply path which are flow path area closing targets of the supply side flexible plate 53 and the ink recovery chamber 139 and the ink discharge chamber 140 of the shared recovery path which are flow path area closing targets of the recovery side flexible plate 54 apart from the coupling portion 91 of the wiring substrate 90. That is, the coupling portion 91 of the wiring substrate 90 does not overlap in the plan view from the Z direction with the flow path area where the supply side flexible plate 53 and the supply liquid chamber 132 overlap in the plan view from the Z direction. Further, the coupling portion 91 of the wiring substrate 90 does not overlap in the plan view from the Z direction with the flow path area where the recovery side flexible plate 54 and the ink recovery chamber 139 overlap in the plan view from the Z direction. Therefore, since it is possible to prevent the wiring substrate 90 overlapping with the second recovery flow path 137 serving as a part of the individual recovery path from overlapping with the shared supply path and the shared recovery path, the flow path area of the ink inflow chamber 131 and the supply liquid chamber 132 and the flow path area of the ink recovery chamber 139 and the ink discharge chamber 140 are secured and it is possible to secure the pressure damping effect of the ink through the flexing of the supply side flexible plate 53 and the recovery side flexible plate 54. Further, it is possible to prevent the pressing load accompanying the mounting of the wiring substrate 90 from being applied to the flow path area of the ink inflow chamber 131 and the supply liquid chamber 132 and the flow path area of the ink recovery chamber 139 and the ink discharge chamber 140. Therefore, even if the wiring substrate 90 is pressed and mounted in the state where the flow path area is liquid-tightly closed by the supply side flexible plate 53 and the recovery side flexible plate 54, it is possible to prevent the deformation of the flow path shape and the deformation of the flexible plate of the ink inflow chamber 131 and the supply liquid chamber 132 serving as the shared supply paths and the ink recovery chamber 139 and the ink discharge chamber 140 serving as the shared recovery paths in the liquid ejecting apparatus 100 according to the first embodiment.

The wiring substrate 90 which is fixed to the lead electrode 45 and which supplies a signal to the piezoelectric element 44 through the lead electrode 45 is positioned, in a plan view from the lamination direction in which the nozzle plate 52 and the flow path formation substrate 30 are laminated, between the supply liquid chamber 132 and the ink recovery chamber 139 shared by the nozzles N in the liquid ejecting apparatus 100 according to the first embodiment. Therefore, since the pressing load when the wiring substrate 90 is electrically coupled to the piezoelectric element 44 can be received in the area which is neither the flow path area of the supply liquid chamber 132 serving as the shared supply path nor the flow path area of the ink recovery chamber 139 serving as the shared recovery path, it is possible to suppress or avoid the deformation of the flow path shape. Further, since the wiring substrate 90 is provided between the supply liquid chamber 132 and the ink recovery chamber 139, it is possible to downsize the liquid ejecting head 26 in a direction orthogonal to the lamination direction.

In the liquid ejecting apparatus 100 according to the first embodiment, the coupling portion 91, of the wiring substrate 90, contacting with the lead electrode 45 is set to overlap with the second recovery flow path 137 serving as the individual flow path in the plan view from the lamination direction of the substrate and the flow path area of the second recovery flow path 137 with which the coupling portion 91 overlaps is set as a flow path area other than the pressure chamber C. Therefore, since the flow path area of the second recovery flow path 137 serving as the individual flow path overlapping with the coupling portion 91 becomes a flow path area other than the pressure chamber C, the flow path area of the pressure chamber C is secured and it is possible to increase the volume of the pressure variation by the pressure chamber C.

In the liquid ejecting apparatus 100 according to the first embodiment, the flow path area of the second recovery flow path 137 serving as the individual flow path overlapping with the coupling portion 91 is set as the flow path area on the opposite side to the pressure chamber C with respect to the nozzle N, in other words, downstream of the ink flow. Therefore, even if the flow path area of the second recovery flow path 137 overlapping with the coupling portion 91 is narrowed, it is possible to effectively exert the pressure variations by the pressure chamber C to the nozzle.

In the liquid ejecting apparatus 100, the pressure chamber plate 40 according to the first embodiment, the supply flow path substrate 60, and the recovery flow path substrate 70 are laminated on the flow path formation substrate 30 on the same side with respect to the flow path formation substrate 30 in the lamination direction of each substrate described above. Therefore, compared with the configuration in which the supply flow path substrate 60 and the recovery flow path substrate 70 are laminated on the pressure chamber plate 40, it is possible to downsize the pressure chamber plate 40 in the plan view from the lamination direction.

In the liquid ejecting apparatus 100 according to the first embodiment, the coupling portion 91, of the wiring substrate 90, contacting with the lead electrode 45 is set to overlap with the flow path area of the second recovery flow path 137 serving as the individual flow path in the lamination direction of each substrate described above. Therefore, the pressing load when the coupling portion 91 is coupled to the piezoelectric element 44 can be received by the partition wall 136A of the second recovery flow path 137 serving as one of the individual flow paths regardless of the shape or posture of the wiring substrate 90. When the wiring substrate 90 has one or more coupling portions 91, at least one coupling portion 91 may overlap with one of the individual flow paths, or the center of the small area including any one or more coupling portions may overlap with the second recovery flow path 137 serving as one of the individual flow paths. Further, a part of the coupling portion 91 may overlap with the second recovery flow path 137 serving as one of the individual flow paths.

According to the first embodiment, since the liquid ejecting apparatus 100 includes the liquid ejecting head 26 configured to suppress or avoid the deformation of the flow path shape and the liquid container 14 storing the ink which is to be supplied to the liquid ejecting head 26 and circulated back, it is possible to enhance the quality of the printed matter obtained by the ink ejection from the liquid ejecting head 26.

According to the manufacturing method of the liquid ejecting apparatus 100, specifically the manufacturing method of the liquid ejecting head 26, of the first embodiment, the pressing load when the wiring substrate 90 is electrically coupled to the piezoelectric element 44 through the lead electrode 45 may be received by the partition wall 136A of the adjacent second recovery flow paths 137. Therefore, according to the manufacturing method of the first embodiment, it is possible to manufacture the liquid ejecting head 26 of the liquid ejecting apparatus 100 while the deformation of the flow path shape of the second recovery flow path 137 abutting on the coupling portion 91 caused by the pressing of the wiring substrate 90 is suppressed or avoided.

In the liquid ejecting apparatus 100 according to the first embodiment, when the recovery communication flow path 135, through which the ink not ejected from the nozzle N first passes, and the ink recovery chamber 139 are made to communicate with each other, a plate mounting seat 141 is formed on the substrate lower surface side by the second recovery flow path 137 formed as a recessed groove on the substrate upper surface of the flow path formation substrate 30. For example, when a part of flow path area of the recessed groove and the through hole formed on the substrate lower surface of the flow path formation substrate 30 is configured to be liquid-tightly sealed by the nozzle plate 52 and the remaining flow path area of the recessed groove and the through hole is liquid-tightly sealed by the recovery side flexible plate 54, since the flow path area closed by the nozzle plate 52 and the flow path area closed by the recovery side flexible plate 54 are continuous on the substrate lower surface of the flow path formation substrate 30, it is difficult to form the nozzle plate 52 and the recovery side flexible plate 54 on the substrate lower surface of the flow path formation substrate 30 while liquid-tightly sealing those flow path areas. However, as described above, out of the flow path areas of the recessed groove and the through hole formed on the substrate lower surface of the flow path formation substrate 30, the flow path area closed by the nozzle plate 52 and the flow path area closed by the recovery side flexible plate 54 are not continuous on the substrate lower surface of the flow path formation substrate 30 by the second recovery flow path 137 formed on the substrate upper surface of flow path formation substrate 30, so that those flow path areas are easily closed. Therefore, as illustrated in FIG. 4, it is possible to securely mount the nozzle plate 52 and the recovery side flexible plate 54 to the substrate lower surface of the flow path formation substrate 30.

In the liquid ejecting apparatus 100 according to the first embodiment, the flow path area of the ink inflow chamber 131 and the supply liquid chamber 132 to be closed by the supply side flexible plate 53 and the flow path area of the ink recovery chamber 139 and the ink discharge chamber 140 to be closed by the recovery side flexible plate 54 are set to be the substrate lower surface on which the nozzle plate 52 is to be mounted. Therefore, in the liquid ejecting apparatus 100 according to the first embodiment, since the nozzle plate 52, the supply side flexible plate 53, and the recovery side flexible plate 54 only need mounting on the substrate lower surface of the flow path formation substrate 30, it is possible to promote the reduction of assembling man-hour and cost in plate mounting.

Second Embodiment

Figure 7:
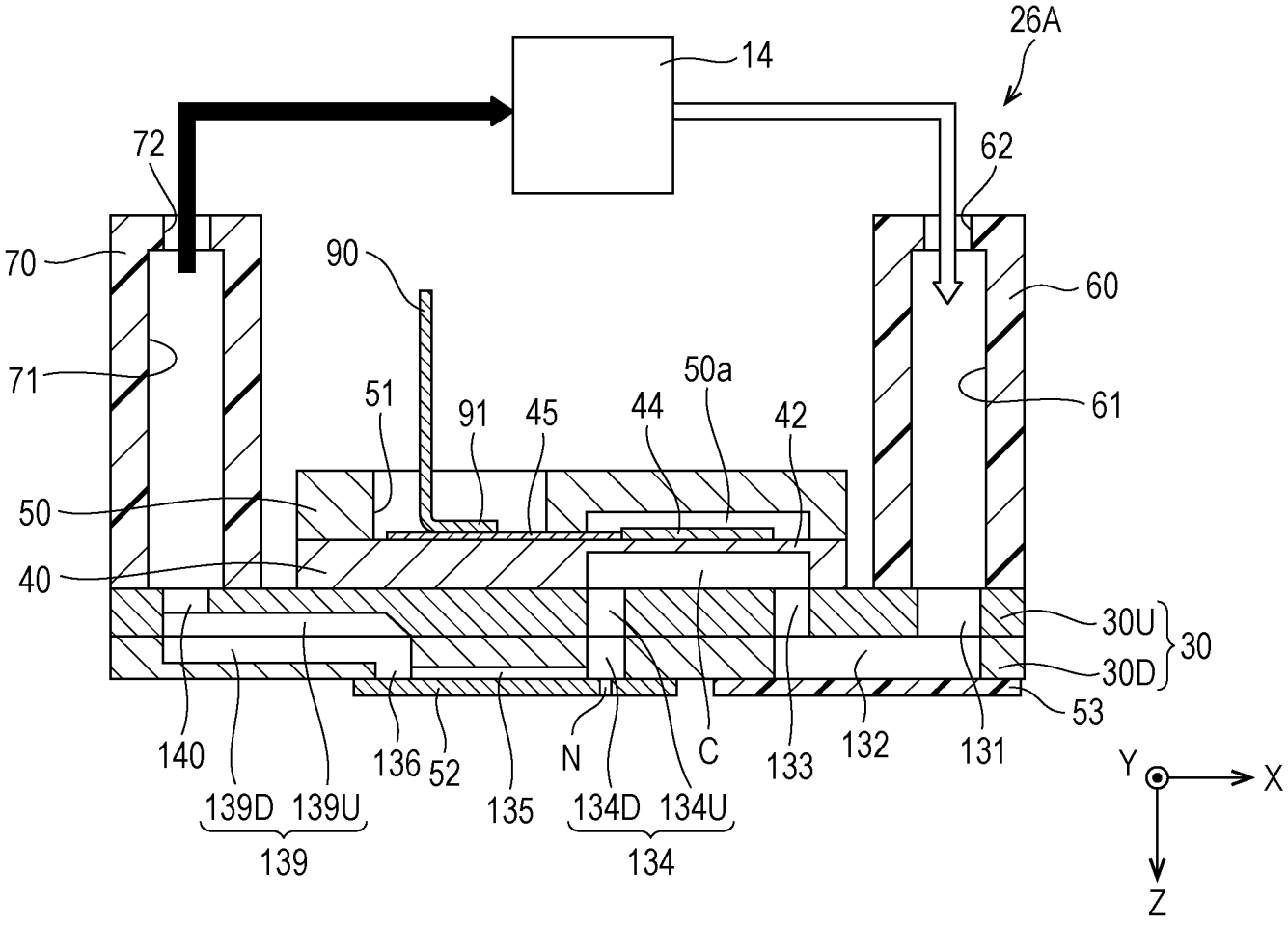
FIG. 7 is a sectional view, corresponding to FIG. 4, illustrating a liquid ejecting head in a liquid ejecting apparatus according to a second embodiment.
Figure 8:
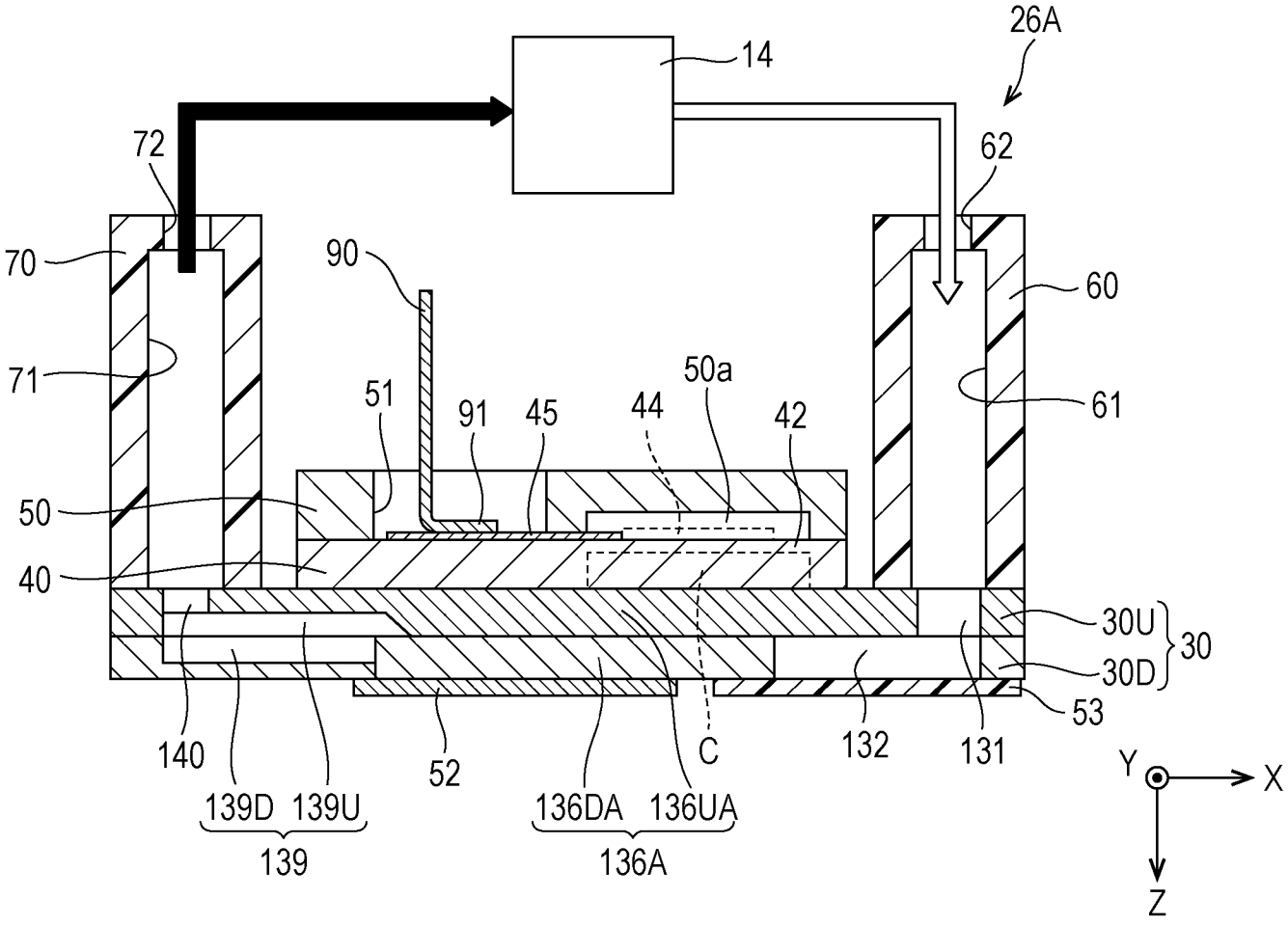
FIG. 8 is a sectional view, corresponding to FIG. 5, illustrating the liquid ejecting head in the liquid ejecting apparatus according to the second embodiment.

FIG. 7 is a sectional view, corresponding to FIG. 4, illustrating a liquid ejecting head 26A in the liquid ejecting apparatus according to the second embodiment. FIG. 8 is a sectional view, corresponding to FIG. 5, illustrating the liquid ejecting head 26A in the liquid ejecting apparatus according to the second embodiment. In the following description, the same reference numerals will be used for the flow path configuration and constituting members as long as their functions are the same for the sake of convenience of description.

In the liquid ejecting head 26A illustrated in FIGS. 7 and 8, the flow path formation substrate 30 assumes a substrate lamination form in which the first flow path substrate 30U on the pressure chamber plate 40 side and a second flow path substrate 30D laminated to a first flow path substrate 30U from the nozzle plate 52 side are liquid-tightly joined and the wiring substrate 90 is superimposed over the flow path area of the recovery communication flow path 135 included in the individual recovery path. Then, each flow path from the ink inflow chamber 131 to the ink discharge chamber 140 is formed in the first flow path substrate 30U and the second flow path substrate 30D separately or by the joining of the two flow path substrates in the following manner.

The ink inflow chamber 131 is a rectangular through hole which passes through the first flow path substrate 30U in the Z direction and which is elongated in the Y direction (refer to FIG. 2A). The supply liquid chamber 132 is a rectangular through hole passing through the second flow path substrate 30D in the Z direction, is elongated in the Y direction, communicates with the ink inflow chamber 131 of the first flow path substrate 30U in the +X direction, and is closed over the flow path area by the supply side flexible plate 53. The supply flow path 133 is a through hole passing through the first flow path substrate 30U in the Z direction and the pressure chamber C and the supply liquid chamber 132 of the second flow path substrate 30D communicate with each other through the supply flow path 133. The supply flow path 133 is provided for each pressure chamber C. The ink inflow chamber 131 and the supply liquid chamber 132 may be polygonal or circular instead of being rectangular.

The nozzle communication flow path 134 per nozzle N is divided into an upstream communication flow path 134U serving as a through hole passing through the first flow path substrate 30U in the Z direction and a downstream communication flow path 134D serving as a through hole passing through the second flow path substrate 30D in the Z direction and is formed by the lamination of the second flow path substrate 30D to the first flow path substrate 30U. The recovery communication flow path 135 per nozzle N is a rectangular recessed groove formed for each nozzle N on the substrate lower surface of the second flow path substrate 30D, and the path area is longer than in the first embodiment in the X direction. The recovery communication flow path 135 may be polygonal or circular instead of being rectangular. The first recovery flow path 136 per nozzle N is a through hole passing through the second flow path substrate 30D in the Z direction and communicates with the downstream communication flow path 134D of the nozzle communication flow path 134 through the recovery communication flow path 135.

In the liquid ejecting head 26A according to the second embodiment, the second recovery flow path 137 and the third recovery flow path 138 are omitted, and the ink recovery chamber 139 is divided into an upstream recovery chamber 139U of a rectangular recessed groove formed on the substrate lower surface of the first flow path substrate 30U in the Y direction and a downstream recovery chamber 139D of a rectangular recessed groove formed on the substrate upper surface of the second flow path substrate 30D in the Y direction and is formed by the lamination of the second flow path substrate 30D to the first flow path substrate 30U. The upstream recovery chamber 139U and the downstream recovery chamber 139D may be polygonal or circular instead of being rectangular. Then, the first recovery flow path 136 communicates with the downstream recovery chamber 139D. The ink discharge chamber 140 is a rectangular through hole passing through the first flow path substrate 30U in the Z direction and is elongated in the Y direction (refer to FIG. 2A) and communicates with the upstream recovery chamber 139U in the ink recovery chamber 139.

The supply flow path 133 and the upstream communication flow path 134U of the individual supply paths adjacent to each other in the first flow path substrate 30U are partitioned by a first partition wall 136UA, of a partition wall 136A, on the first flow path substrate 30U side. The downstream communication flow path 134D, the recovery communication flow path 135, and the first recovery flow path 136 of the individual recovery paths adjacent to each other in the second flow path substrate 30D are partitioned by a second partition wall 136DA, of the partition wall 136A, on the second flow path substrate 30D side. Therefore, these flow paths are not illustrated in FIG. 8.

Since the recovery communication flow path 135 is formed such that the path area is lengthened in the X direction as described above, as illustrated in FIG. 7, the pressure chamber side substrate 50 includes the rectangular through hole 51, which is the installation position of the wiring substrate 90, overlapping with the recovery communication flow path 135 serving as the individual recovery path in the flow path formation substrate 30. Therefore, the wiring substrate 90 overlaps at the coupling portion 91 with the flow path area of the recovery communication flow path 135 serving as a part of the individual recovery path.

In the manufacturing procedure of the liquid ejecting head 26A having the configuration described above, the flow path formation substrate 30 is prepared in the parts preparation in the step S100 such that the flow path formation substrate 30 is formed of the first flow path substrate 30U and the second flow path substrate 30D as the substrates having the flow path configuration described above and that the two substrates are liquid-tightly laminated with an adhesive. The other steps are as described above.

In the liquid ejecting apparatus having the liquid ejecting head 26A described above according to the second embodiment, the flow path formation substrate 30 assumes the substrate lamination form in which the second flow path substrate 30D is liquid-tightly laminated to the first flow path substrate 30U and then the ink supply flow path and the ink recovery flow path are formed on the first flow path substrate 30U and the second flow path substrate 30D separately or jointly. Specifically, various flow paths except for the recovery communication flow path 135 and the ink recovery chamber 139 may be formed of through holes passing through the first flow path substrate 30U or the second flow path substrate 30D. As a result, in the liquid ejecting apparatus having the liquid ejecting head 26A according to the second embodiment, it is possible to simplify the flow path shape in each of the first flow path substrate 30U and the second flow path substrate 30D and, by the simplification, it is possible to promote the reduction of assembling man-hour and cost in plate mounting.

According to the second embodiment, since the wiring substrate 90 is mounted so as to overlap with the flow path area of the recovery communication flow path 135 serving as a part of the individual recovery path of the flow path formation substrate 30, it is possible to achieve the effect of suppressing the deformation of the flow path shape also by the liquid ejecting apparatus having the liquid ejecting head 26A.

Third Embodiment

Figure 9:
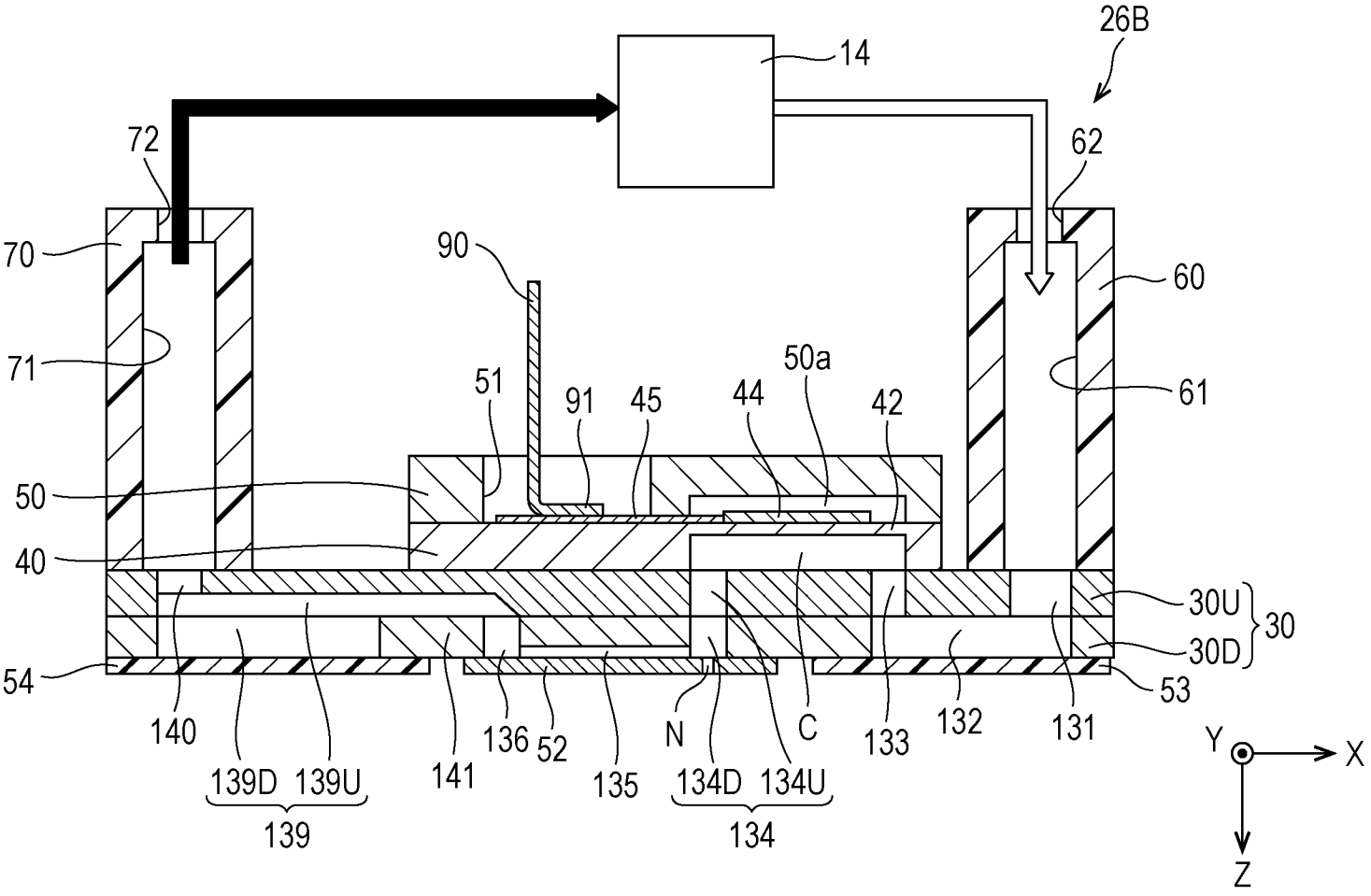
FIG. 9 is a sectional view, corresponding to FIG. 4, illustrating a liquid ejecting head in a liquid ejecting apparatus according to a third embodiment.
Figure 10:
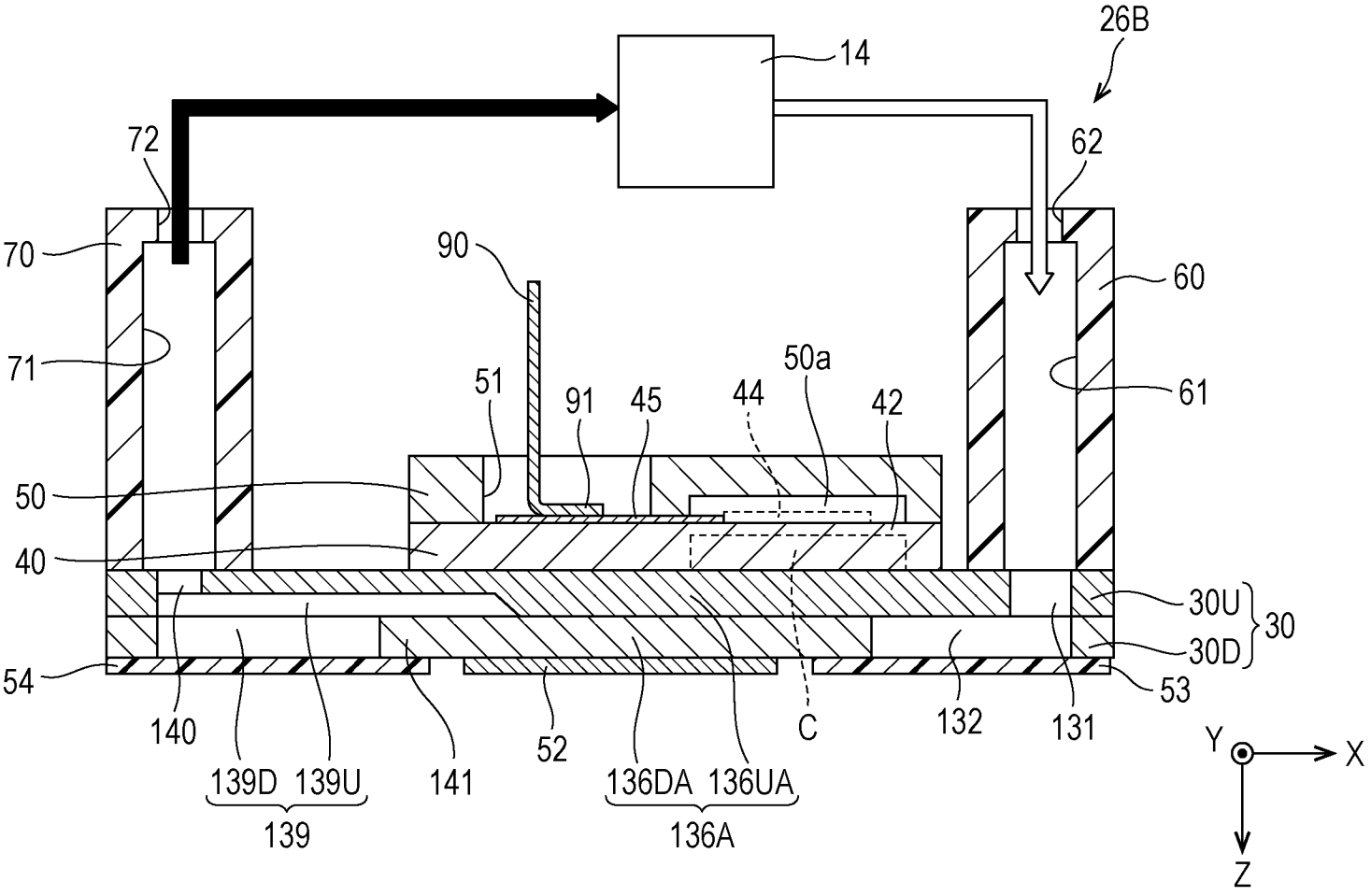
FIG. 10 is a sectional view, corresponding to FIG. 5, illustrating the liquid ejecting head in the liquid ejecting apparatus according to the third embodiment.

FIG. 9 is a sectional view, corresponding to FIG. 4, illustrating a liquid ejecting head 26B in a liquid ejecting apparatus according to a third embodiment. FIG. 10 is a sectional view, corresponding to FIG. 5, illustrating the liquid ejecting head 26B in the liquid ejecting apparatus according to the third embodiment.

The liquid ejecting head 26B illustrated in FIGS. 9 and 10 is in common with the liquid ejecting head 26A in that the flow path formation substrate 30 assumes a substrate lamination form of the first flow path substrate 30U and the second flow path substrate 30D and that the ink recovery chamber 139 is closed by the recovery side flexible plate 54 over the flow path area thereof.

In the liquid ejecting head 26B, the downstream recovery chamber 139D is a rectangular through hole which penetrates the second flow path substrate 30D in the Z direction and which is elongated in the Y direction, and the plate mounting seat 141 is formed between the downstream recovery chamber 139D and the first recovery flow path 136. Then, the nozzle plate 52 and the recovery side flexible plate 54 are mounted to the plate mounting seat 141 on the substrate lower surface of the second flow path substrate 30D. In this way, in the liquid ejecting apparatus having the liquid ejecting head 26B according to the third embodiment, it is possible to promote the pressure damping in the ink recovery chamber 139, specifically, downstream recovery chamber 139D, on the ink recovery side by the recovery side flexible plate 54.

In FIG. 10, the supply flow path 133 and the upstream communication flow path 134U of the first flow path substrate 30U and the downstream communication flow path 134D, the recovery communication flow path 135, and the first recovery flow path 136 of the second flow path substrate 30D are not illustrated. This is because these flow paths are partitioned by the first partition wall 136UA and the second partition wall 136DA, as described above.

Fourth Embodiment

Figure 11:
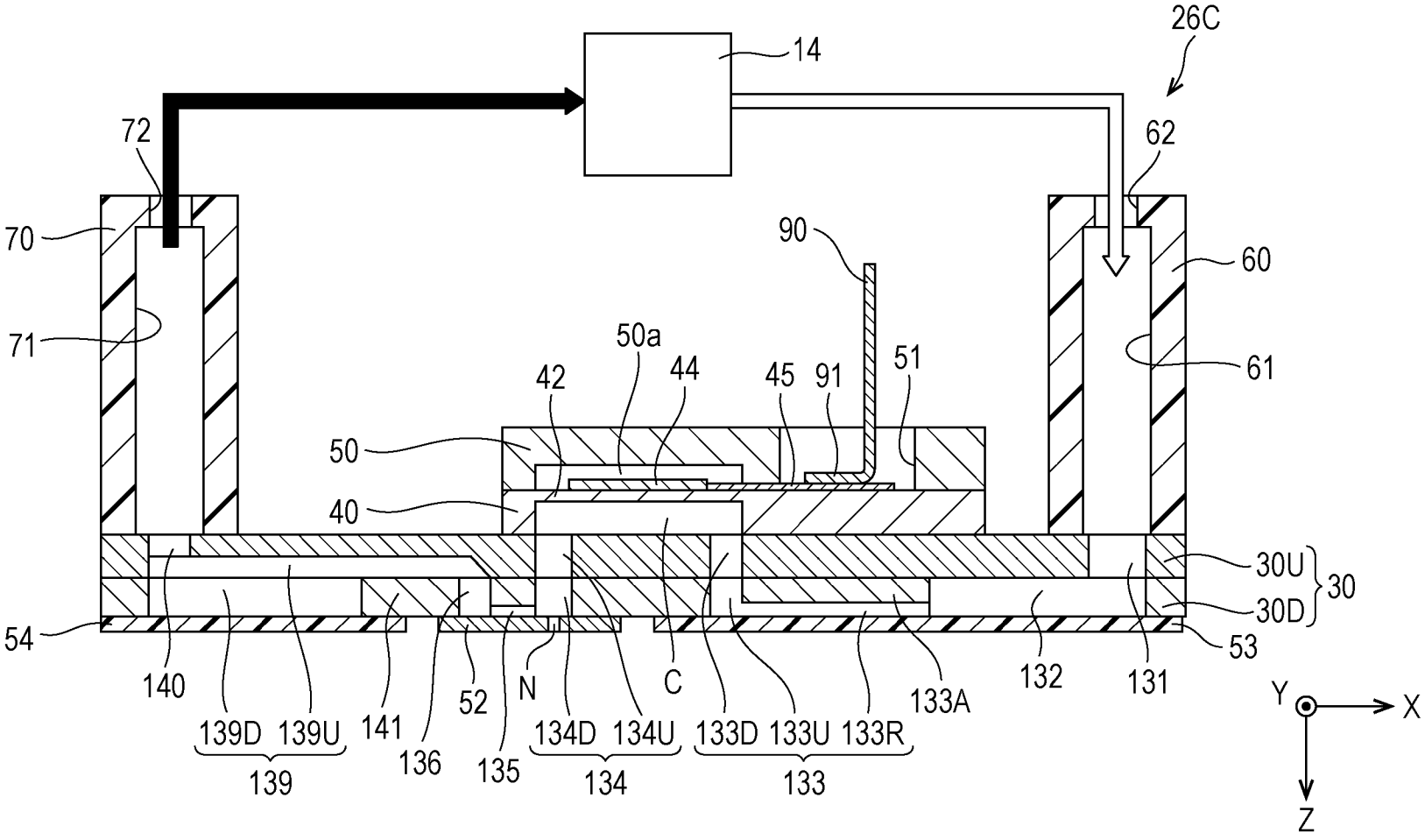
FIG. 11 is a sectional view, corresponding to FIG. 4, illustrating a liquid ejecting head in a liquid ejecting apparatus according to a fourth embodiment.
Figure 12:
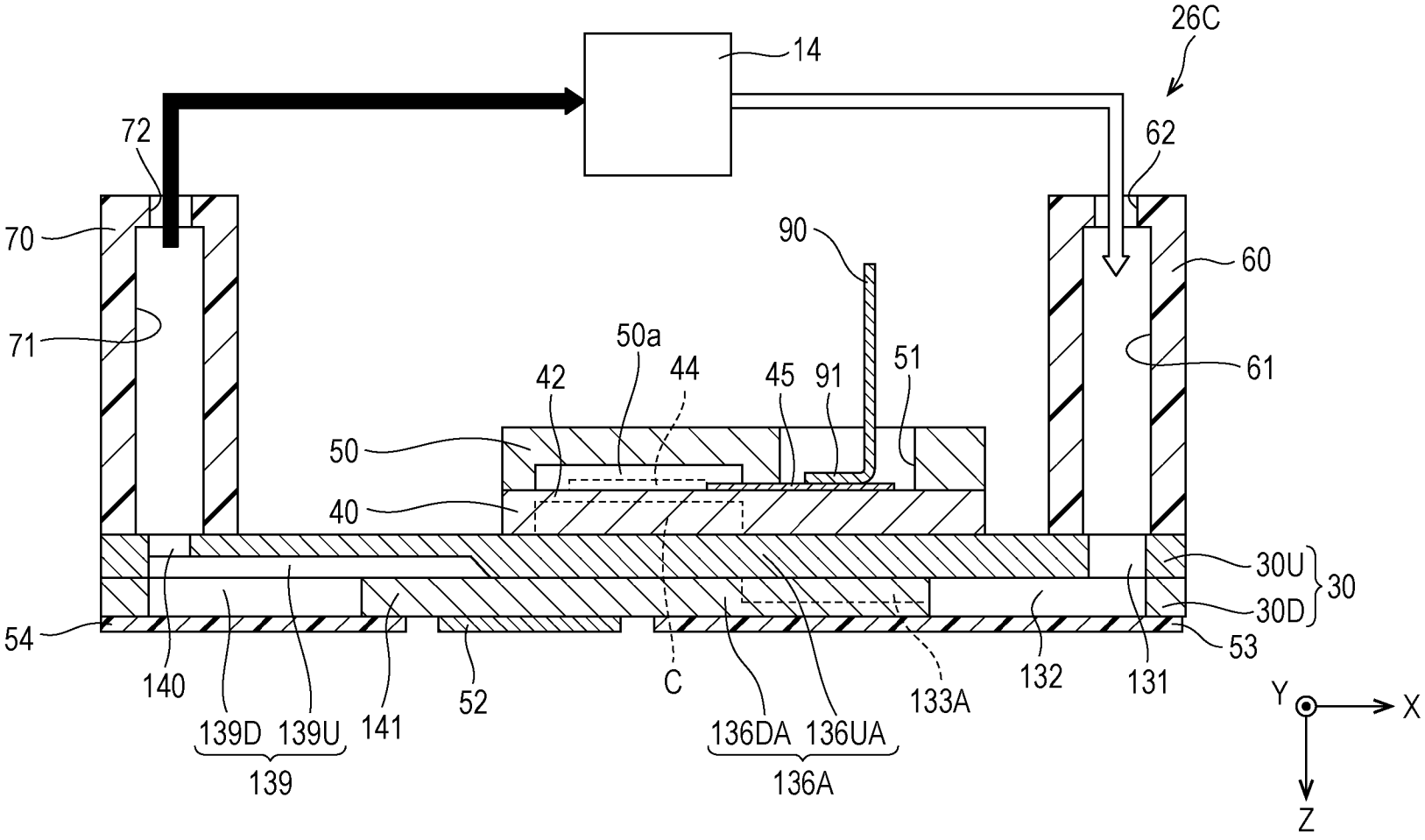
FIG. 12 is a sectional view, corresponding to FIG. 5, illustrating the liquid ejecting head in the liquid ejecting apparatus according to the fourth embodiment.

FIG. 11 is a sectional view, corresponding to FIG. 4, illustrating a liquid ejecting head 26C in a liquid ejecting apparatus according to a fourth embodiment. FIG. 12 is a sectional view, corresponding to FIG. 5, illustrating the liquid ejecting head 26C in the liquid ejecting apparatus according to the fourth embodiment.

The liquid ejecting head 26C illustrated in FIGS. 11 and 12 are in common with the liquid ejecting head 26B in that the flow path formation substrate 30 assumes a substrate lamination form of the first flow path substrate 30U and the second flow path substrate 30D, that the ink recovery chamber 139 is closed by the recovery side flexible plate 54, and that the wiring substrate 90 is superimposed on the flow path area of the individual supply path of the ink.

The supply liquid chamber 132 is formed as a through hole penetrating the second flow path substrate 30D in the Z direction, but the supply flow path 133 of the individual supply path communicating with the supply liquid chamber 132 is divided into an upstream supply flow path 133U serving as a through hole penetrating the second flow path substrate 30D in the Z direction, a downstream supply flow path 133D serving as a through hole penetrating the first flow path substrate 30U in the Z direction, and a connection supply flow path 133R which is a recessed groove formed on the substrate lower surface of the second flow path substrate 30D in the X direction, and is formed by lamination of the second flow path substrate 30D to the first flow path substrate 30U. The connection supply flow path 133R may be polygonal or circular instead of being rectangular. The connection supply flow path 133R is formed for each nozzle N like the upstream supply flow path 133U and the downstream supply flow path 133D and communicates with the downstream supply flow path 133D branching off from the supply liquid chamber 132. Then, in the flow path formation substrate 30, a partition wall 133A surrounded by the upstream supply flow path 133U, the connection supply flow path 133R, and the supply liquid chamber 132 in the second flow path substrate 30D is formed. The partition wall 133A protrudes from the substrate lower surface side of the first flow path substrate 30U, that is, from the substrate upper surface of the second flow path substrate 30D, in the +Z direction so as to partition the adjacent connection supply flow paths 133R.

In FIG. 12, the downstream supply flow path 133D and the upstream communication flow path 134U of the first flow path substrate 30U and the upstream supply flow path 133U, the connection supply flow path 133R, the downstream communication flow path 134D, the recovery communication flow path 135, and the first recovery flow path 136 of the second flow path substrate 30D are not illustrated. This is because, as described above, these paths are partitioned by the first partition wall 136UA and the second partition wall 136DA. Further, since the partition wall 133A occupies a part of the area of the second partition wall 136DA illustrated in FIG. 11, the second partition wall 136DA is denoted by a dotted line in FIG. 12.

In the liquid ejecting apparatus having the liquid ejecting head 26C according to the fourth embodiment, since the wiring substrate 90 is mounted so as to overlap with the flow path area of the supply flow path 133 serving as a part of the individual supply path of the flow path formation substrate 30, it is also possible to achieve the effect of suppressing the deformation of the flow path shape.

Fifth Embodiment

Figure 13:
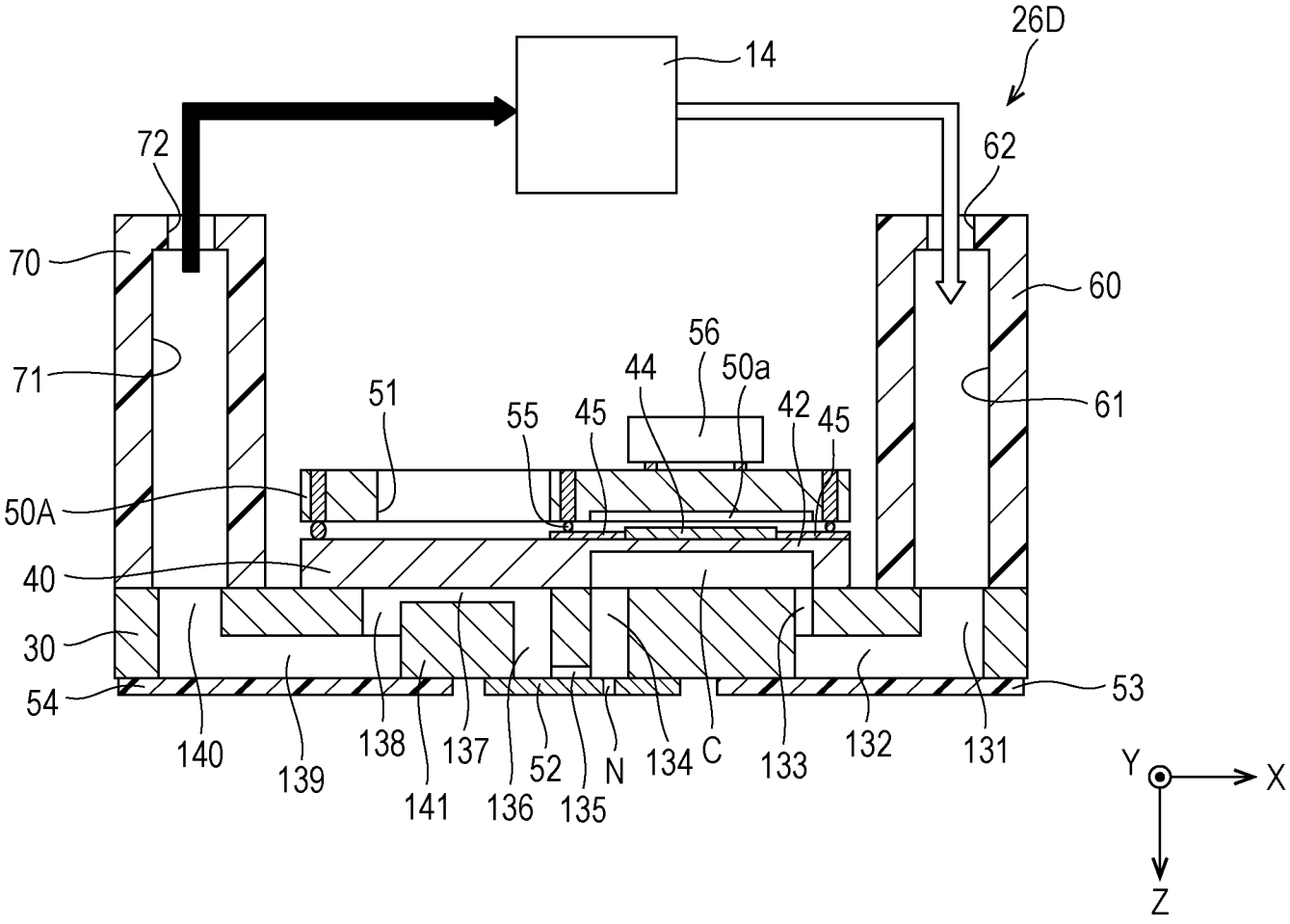
FIG. 13 is a sectional view, corresponding to FIG. 4, illustrating a liquid ejecting head in a liquid ejecting apparatus according to a fifth embodiment.
Figure 14:
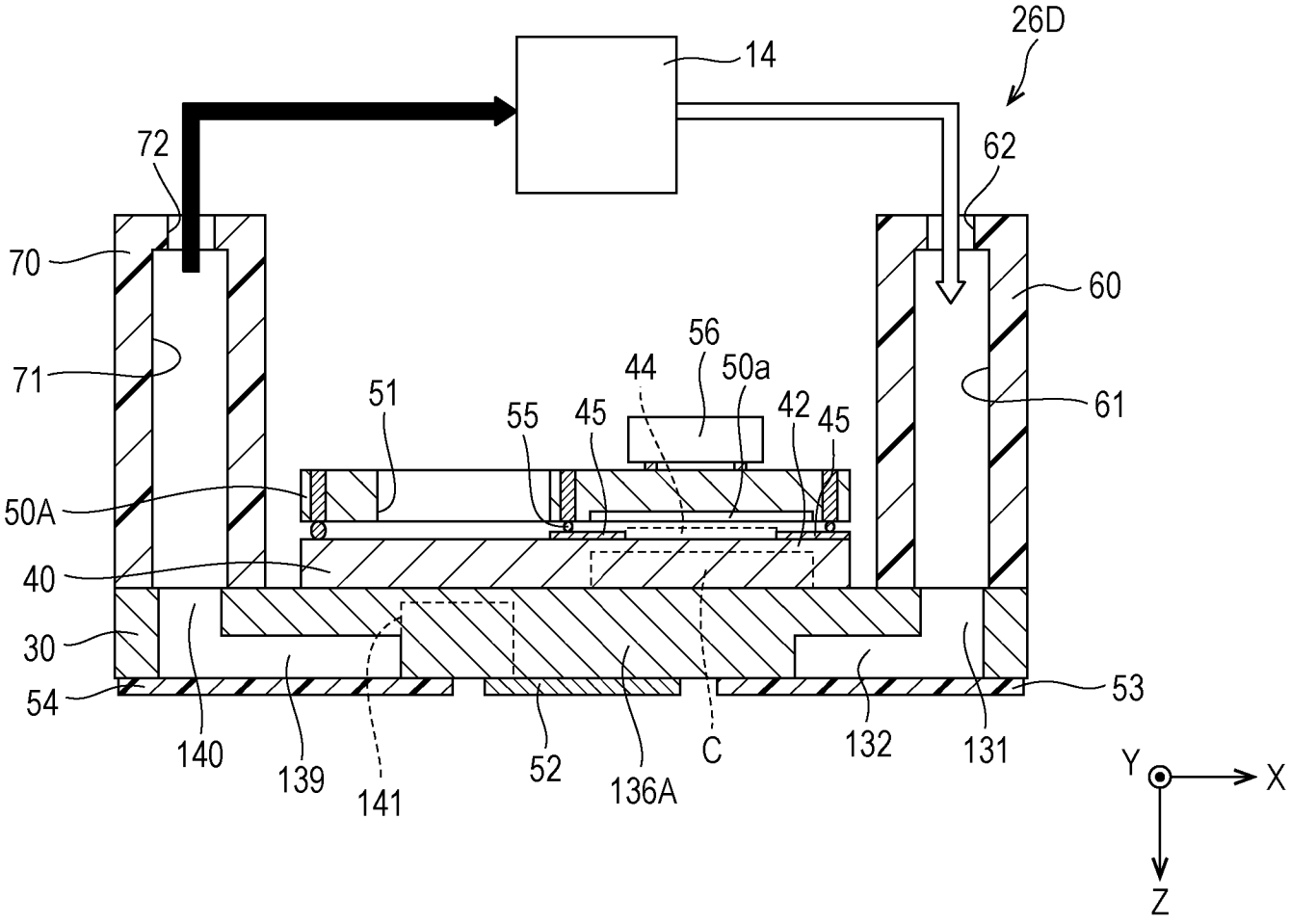
FIG. 14 is a sectional view, corresponding to FIG. 5, illustrating the liquid ejecting head in the liquid ejecting apparatus according to the fifth embodiment.

FIG. 13 is a sectional view, corresponding to FIG. 4, illustrating a liquid ejecting head 26D in a liquid ejecting apparatus according to a fifth embodiment. FIG. 14 is a sectional view, corresponding to FIG. 5, illustrating the liquid ejecting head 26D in the liquid ejecting apparatus according to the fifth embodiment.

The liquid ejecting head 26D illustrated in FIGS. 13 and 14 has the same flow path structure in the flow path formation substrate 30 as the liquid ejecting head 26 according to the first embodiment except that an interposer substrate 50A mounted with a semiconductor chip 56 for generating a drive signal is used for a piezoelectric element 44 causing pressure variations in the pressure chamber C. The interposer substrate 50A electrically couples the semiconductor chip 56 to the piezoelectric element 44 by establishing conduction between the lead electrodes 45 provided on the front side and the rear side respectively and the semiconductor chip 56 by a through electrode 55. The interposer substrate 50A is mounted on the flow path formation substrate 30 from the opposite side to the nozzle plate 52. Therefore, the interposer substrate 50A corresponds to the wiring substrate 90 described above and, in cooperation with the lead electrode 45, constitutes a mode of the conduction unit in the present disclosure. An appropriate adhesive is used in the mounting of the interposer substrate 50A so that the electrical coupling of the through electrode 55 and the lead electrode 45 is maintained.

When the interposer substrate 50A is mounted to the flow path formation substrate 30 such that the pressure chamber plate 40 is interposed between the interposer substrate 50A and the flow path formation substrate 30, the load is applied to the partition walls 136A of the first recovery flow path 136, the second recovery flow path 137, and the third recovery flow path 138 serving as individual recovery paths, and also to the recovery communication flow path 135 abutting on the Z direction side of the through electrode 55. Since the partition wall 136A partitioning the first recovery flow path 136, the second recovery flow path 137, and the third recovery flow path 138 adjacent to each other also partitions the recovery communication flow path 135 arranged in the Y direction, the load applied to the recovery communication flow path 135 can also be received by the partition wall 136A in the recovery communication flow path 135. Therefore, in the liquid ejecting apparatus having the liquid ejecting head 26D according to the fifth embodiment, it is also possible to suppress or avoid the deformation of the flow path shape when the interposer substrate 50A mounted with the semiconductor chip 56 is mounted.

Other Embodiments (F-1) In the embodiments described above, ink is supplied to the pressure chamber C from the side of the ink inflow chamber 131 formed by the flow path formation substrate 30 and the ink that passes through the pressure chamber C is recovered from the side of the ink discharge chamber 140, but this flow of ink may be reversed. Specifically, ink may be supplied to the pressure chamber C from the side of the ink discharge chamber 140 illustrated in FIG. 4, and the ink that passes through the pressure chamber C may be recovered from the side of the ink inflow chamber 131.

(F-2) In the embodiments described above, the liquid ejecting head 26 has the nozzle N in a row but may have the nozzle N in two rows.

(F-3) The present disclosure is not limited to a liquid ejecting apparatus ejecting ink, but can be applied to any liquid ejecting apparatus ejecting a liquid other than ink. For example, various liquid ejecting apparatuses to which the present disclosure may be applied are as follows:

(1) An image recording apparatus such as a facsimile apparatus (2) A color ejecting apparatus used in the manufacturing of a color filter for an image displaying apparatus such as a liquid crystal display or the like (3) An electrode material ejecting apparatus used in electrode formation such as an organic electro luminescence (EL) display, field emission display (FED), or the like (4) A liquid ejecting apparatus ejecting a liquid containing bioorganic matter used in manufacturing a biochip (5) A sample injecting apparatus as a precision pipette (6) An ejecting apparatus of lubricating oil (7) An ejecting apparatus of resin liquid (8) A liquid ejecting apparatus injecting lubricating oil at pinpoint to a precision machine such as a watch, a camera, or the like (9) A liquid ejecting apparatus ejecting on a substrate a transparent resin liquid such as an ultraviolet curing resin or the like to form a micro hemispherical lens (optical lens) or the like used in an optical communication element or the like

(10) A liquid ejecting apparatus ejecting an acidic or alkaline etching solution to etch a substrate or the like

(11) A liquid ejecting apparatus including a liquid ejecting head ejecting any small amount of a liquid droplet "Droplet" refers to a state of a liquid ejected from a liquid ejecting apparatus and also includes a granule, a teardrop, and a thread tail. Further, "liquid" as referred to herein may be any material that can be consumed by a liquid ejecting apparatus. For example, "liquid" may be any material as long as the material is in a liquid state and also includes a material in a liquid state with a high or low viscosity and a material in a liquid state such as sol, gel water, other inorganic solvents, organic solvents, liquid resins and liquid metals (metal melt). Further, not only a liquid as a state of a matter but also solvents in which particles of functional materials made of paints or metal particles are dissolved, distributed, or mixed are also included in "liquid". A typical example of a liquid includes ink and liquid crystal. Here, the ink includes various compositions in a liquid state such as a usual water-based ink, oil-based ink, gel ink, hot melt ink, or the like.

Other Aspects

The present disclosure is not limited to the embodiments described above, embodiments, and modification examples and may be realized in various configurations within a range not deviating from the spirit thereof. For example, the technical features of the embodiments having various aspects of technical features described in the summary of the present disclosure, embodiments, and modification examples may be replaced or combined in order to solve some or all of the problems described above or to achieve some or all of the effects described above. Further, the technical features may be deleted as deemed appropriate unless the features are described as essential in the present specification.

(1) According to an aspect of the present disclosure, there is provided a liquid ejecting head. The liquid ejecting head has a plurality of nozzles ejecting a liquid and includes a nozzle plate having a plurality of the nozzles; a flow path formation substrate having a shared supply path shared in a liquid supply to the plurality of nozzles, an individual supply path branching off from the shared supply path and leading to a pressure chamber of each of the nozzles, an individual recovery path through which the nozzle and the pressure chamber communicate with each other, and a shared recovery path into which the plurality of individual recovery paths merge and which is shared in liquid recovery from the plurality of nozzles; and a lead electrode electrically coupled to a pressure generator causing pressure of the pressure chamber to vary, in which a conduction unit contacting with the lead electrode and supplying a signal to the pressure generator through the lead electrode is located at a position where the conduction unit overlaps with a flow path area of at least one individual flow path of the individual supply path or the individual recovery path in a plan view from a lamination direction in which the nozzle plate and the flow path formation substrate are laminated.

In the liquid ejecting head according to this aspect, the conduction unit electrically coupled to the pressure generator per nozzle overlaps with the flow path area of an individual flow path of the individual supply path or the individual recovery path of the flow path formation substrate. Since the individual supply path branches off from the shared supply path and leads to the pressure chamber per nozzle, the adjacent individual supply paths are partitioned by the partition wall in the flow path area. Since the individual recovery path communicates with the communication path per nozzle, through which the nozzle and the pressure chamber communicate with each other, for each nozzle, the adjacent individual recovery paths are partitioned by the partition wall in the flow path area. Therefore, in the liquid ejecting head according to this aspect, since the pressing load when the conduction unit is electrically coupled to the pressure generator can be received by the partition wall in the individual supply path or the individual recovery path, it is possible to suppress or avoid the deformation of the flow path shape. Further, in the liquid ejecting head according to this aspect, since the conduction unit and the pressure generator can be electrically coupled to each other in a state where the pressing load is received by the partition wall, it is possible to securely perform the electrical coupling. When a plurality of individual flow paths are provided, the flow path area of the individual flow paths is set to be the minimum area that includes the plurality of individual flow paths and these partition walls.

(2) According to another aspect of the present disclosure, a liquid ejecting head includes a plurality of nozzles ejecting a liquid and includes a nozzle plate having a plurality of the nozzles, a flow path formation substrate having a shared supply path shared in liquid supply to the plurality of nozzles, an individual supply path branching off from the shared supply path and leading to a pressure chamber per nozzle, an individual recovery path through which the nozzle and the pressure chamber communicate with each other, and a shared recovery path into which the plurality of individual recovery paths merge and which is shared in liquid recovery from the plurality of nozzles, and a lead electrode electrically coupled to a pressure generator causing pressure of the pressure chamber to vary, in which a conduction unit which is fixed with the lead electrode and which supplies a signal to the pressure generator through the lead electrode is located between the shared supply path and the shared recovery path in a plan view from a lamination direction in which the nozzle plate and the flow path formation substrate are laminated.

In the liquid ejecting head according to this aspect, since the pressing load when the conduction unit is electrically coupled to the pressure generator may be received in a region where neither the shared supply path nor the shared recovery path is provided, it is possible to suppress or avoid the flow path deformation. Further, since the conduction unit is located between the shared supply path and the shared recovery path, it is possible to downsize the liquid ejecting head in the direction orthogonal to the lamination direction.

(3) In the liquid ejecting head according to the above aspect, a length of the coupling portion, of the conduction unit, contacting with the lead electrode in a plan view from the lamination direction may be made shorter than a flow path length of the flow path overlapping with the conduction unit in a plan view. In this configuration, since the pressing load when the conduction unit is electrically coupled to the pressure generator can be received by the partition wall in the individual supply path or the individual recovery path securely, it is possible to suppress or avoid the deformation of the flow path more securely.

(4) In the liquid ejecting head according to the above aspect, in the plan view from the lamination direction, the flow path formation substrate includes at least one of the shared supply path and the shared recovery path apart from the coupling portion, of the conduction unit, contacting with the lead electrode, and the flow path area of the shared supply path and the flow path area of the shared recovery path may be liquid-tightly closed by a flexible plate. In this way, since the conduction unit overlapping with the individual supply path or the individual recovery path can avoid overlapping with the shared supply path or the shared recovery path, the flow path area of the shared supply path or the shared recovery path is secured wide and it is possible to secure pressure damping effect of the liquid by the flexible plate. Further, since the pressing load when the conduction unit is electrically coupled to the pressure generator can be made not to apply to the flow path area of the shared supply path or the shared recovery path, it is possible to prevent the occurrence of the deformation of the flow path shape of the shared supply path or the shared recovery path or the deformation of the flexible plate even if the conduction unit is electrically coupled to the pressure generator in a state where the flow path area is liquid-tightly closed by the flexible plate.

(5) In the liquid ejecting head according to the above aspect, the coupling portion, of the conduction unit, contacting with the lead electrode is located at a position where the coupling portion overlaps, in a plan view from the lamination direction, with the flow path area of the flow path with which the conduction unit overlaps, and a flow path area of the flow path overlapping with the coupling portion may be made a flow path area other than the pressure chamber. In this configuration, since the flow path area of the individual flow path overlapping with the coupling portion is the flow path area other than the pressure chamber, the flow path area of the pressure chamber is secured wide and it is possible to increase the volume of the pressure variation generated by the pressure chamber.

(6) In the liquid ejecting head according to the above aspect, the flow path area of the individual flow path overlapping with the coupling portion may be made a flow path area, of the individual flow path, on a side opposite to the pressure chamber with respect to the nozzle. In this configuration, since the flow path area of the individual flow path overlapping with the coupling portion is a flow path area, of the individual flow path, on the side opposite to the pressure chamber with respect to the nozzle, it is possible to effectively apply the pressure variation generated by the pressure chamber to the nozzle even if the flow path area of the individual flow path overlapping with the coupling portion is narrowed.

(7) In the liquid ejecting head according to the above aspect, a coupling portion, of the conduction unit, contacting with the lead electrode is located at a position where the coupling portion overlaps, in a plan view from the lamination direction, with the flow path area of the flow path overlapping with the conduction unit, and a depth, in the lamination direction, of the flow path area of the flow path overlapping with the coupling portion may be equal to or less than half the distance between the nozzle plate and the coupling portion. In this configuration, since the depth of the flow path area of the individual flow path overlapping with the coupling portion is equal to or less than half the distance between the nozzle plate and the coupling portion, the strength of the individual flow path the pressing load is easily secured.

(8) According to the above aspect, the liquid ejecting head further includes a pressure chamber plate provided with the pressure chamber; a supply flow path substrate having an inlet through which the liquid is introduced and a reception chamber receiving the liquid introduced from the inlet; and a recovery flow path substrate having an accommodation chamber accommodating the liquid recovered from the shared recovery path and an outlet through which the liquid is discharged. The pressure chamber plate, the supply flow path substrate, and the recovery flow path substrate may be laminated to the flow path formation substrate on the same side with respect to the flow path formation substrate in the lamination direction. In this configuration, since the pressure chamber plate, the supply flow path substrate, and the recovery flow path substrate are laminated to the flow path formation substrate on the same side with respect to the flow path formation substrate, it is possible to downsize the pressure chamber plate on a plan view from the lamination direction, compared with the configuration in which the supply flow path substrate and the recovery flow path substrate are laminated to the pressure chamber plate.

(9) In the liquid ejecting head according to the above aspect, a coupling portion, of the conduction unit, contacting with the lead electrode may be located at a position where the coupling portion overlaps with the flow path area of the flow path with which the conduction unit overlaps in the lamination direction. In this configuration, it is possible to receive, by a partition wall of one of the individual flow paths, the pressing load when the coupling portion is electrically coupled to the pressure generator regardless of the shape and the posture of the conduction unit. When the conduction unit has one or more coupling portions, at least one coupling portion may overlap with one of the individual flow paths or the center of the minimum area containing any one or more coupling portions may overlap with one of the individual flow paths. Further, a part of the coupling portion may overlap with one of the individual flow paths.

(10) According to another aspect of the present disclosure, there is provided a liquid ejecting apparatus including a liquid ejecting head in any one of the forms described and a liquid container storing the liquid to be supplied to the liquid ejecting head and recovered from the liquid ejecting head. According to the liquid ejecting apparatus, since the liquid ejecting head configured to suppress or avoid the deformation of the liquid flow shape is provided, it is possible to enhance the quality of an object obtained by the liquid ejection.

(11) According to still another aspect of the present disclosure, there is provided a manufacturing method of a liquid ejecting apparatus having a plurality of nozzles ejecting a liquid, and the manufacturing method includes preparing a nozzle plate having a plurality of the nozzles; preparing a flow path formation substrate having a shared supply path shared in liquid supply to the plurality of nozzles, an individual supply path branching off from the shared supply path and leading to a pressure chamber per nozzle, an individual recovery path through which the nozzle and the pressure chamber communicate with each other, and a shared recovery path into which the plurality of individual recovery paths merge and which is shared in liquid recovery from the plurality of nozzles; preparing a lead electrode electrically coupled to a pressure generator causing pressure of the pressure chamber to vary; and fixing the conduction unit to the lead electrode so that the conduction unit overlaps with the flow path area of at least one individual flow path of the individual supply path or the individual recovery path in a plan view in the lamination direction in which the nozzle plate and the flow path formation substrate are laminated.

According to the manufacturing method of this embodiment, since the pressing load when the conduction unit is mounted to the coupling portion and is electrically coupled to the pressure generator can be received by the partition wall in the individual supply path or the individual recovery path, it is possible to manufacture the liquid ejecting apparatus while the deformation of the flow path shape is suppressed or avoided.

Further, the present disclosure can be realized in various aspects, for example, in the form of a liquid ejecting method or the like.

What is claimed is:

1. A liquid ejecting head having a plurality of nozzles ejecting a liquid, the liquid ejecting head comprising:

a nozzle plate having a plurality of the nozzles;

a flow path formation substrate having a shared supply path shared in liquid supply to the plurality of nozzles, an individual supply path branching off from the shared supply path and leading to a pressure chamber per nozzle, an individual recovery path through which the nozzle and the pressure chamber communicate with each other, and a shared recovery path into which the plurality of individual recovery paths merge and which is shared in liquid recovery from the plurality of nozzles; and a lead electrode electrically coupled to a pressure generator causing pressure of the pressure chamber to vary, and a conduction unit contacting with the lead electrode and supplying a signal to the pressure generator through the lead electrode, wherein the conduction unit is located at a position where the conduction unit overlaps with one of the individual supply path and the individual recovery path in a plan view and does not overlap with the other of the individual supply path or the individual recovery path in the plan view, the plan view being view from a lamination direction in which the nozzle plate and the flow path formation substrate are laminated.

2. The liquid ejecting head according to claim 1, wherein a length of a coupling portion, of the conduction unit, contacting with the lead electrode in the plan view is shorter than a flow path length of a flow path with which the conduction unit overlaps in the plan view.

3. The liquid ejecting head according to claim 1, wherein the flow path formation substrate includes at least one of the shared supply path and the shared recovery path apart from a coupling portion, of the conduction unit, contacting with the lead electrode in the plan view, and a flow path area of the shared supply path and a flow path area of the shared recovery path are liquid-tightly closed by a flexible plate.

4. The liquid ejecting head according to claim 1, wherein a coupling portion, of the conduction unit, contacting with the lead electrode is located at a position where the coupling portion overlaps, in the plan view, with the flow path area of a flow path with which the conduction unit overlaps, and a flow path area of the flow path with which the coupling portion overlaps is a flow path area other than the pressure chamber.

5. The liquid ejecting head according to claim 4, wherein the flow path area of the individual flow path with which the coupling portion overlaps is a flow path area, of the individual flow path, on a side opposite to the pressure chamber with respect to the nozzle.

6. The liquid ejecting head according to claim 1, wherein a coupling portion, of the conduction unit, contacting with the lead electrode is located at a position where the coupling portion overlaps, in the plan view, with a flow path area of a flow path with which the conduction unit overlaps, and a depth, in the lamination direction, of a flow path area of the flow path with which the coupling portion overlaps is equal to or less than half a distance between the nozzle plate and the coupling portion.

7. The liquid ejecting head according to claim 1, further comprising:

a pressure chamber plate provided with the pressure chamber;

a supply flow path substrate having an inlet through which the liquid is introduced and a reception chamber receiving the liquid introduced from the inlet; and a recovery flow path substrate having an accommodation chamber accommodating the liquid recovered from the shared recovery path and an outlet through which the liquid is discharged, wherein the pressure chamber plate, the supply flow path substrate, and the recovery flow path substrate are on an identical side with respect to the flow path formation substrate and are laminated to the flow path formation substrate in the lamination direction.

8. The liquid ejecting head according to claim 1, wherein a coupling portion, of the conduction unit, contacting with the lead electrode is located at a position where the coupling portion overlaps with a flow path area of a flow path with which the conduction unit overlaps in the lamination direction.

9. A liquid ejecting apparatus comprising:

the liquid ejecting head according to claim 1; and a liquid container storing the liquid to be supplied to the liquid ejecting head and recovered from the liquid ejecting head.

10. The liquid ejecting head according to claim 1, wherein the position where the conduction unit is located does not overlap with the shared supply path and the shared recovery path in the plan view.

11. The liquid ejecting head according to claim 1, wherein the shared supply path, the individual supply path, the individual recovery path, and the shared recovery path are located this order in the plan view.

12. The liquid ejecting head according to claim 1, wherein the shared supply path, the individual supply path, the individual recovery path, and the shared recovery path are located same position in the lamination direction.

13. A liquid ejecting head having a plurality of nozzles ejecting a liquid, the liquid ejecting head comprising:

a nozzle plate having a plurality of the nozzles;

a flow path formation substrate having a shared supply path shared in liquid supply to the plurality of nozzles, an individual supply path branching off from the shared supply path and leading to a pressure chamber per nozzle, an individual recovery path through which the nozzle and the pressure chamber communicate with each other, and a shared recovery path into which the plurality of individual recovery paths merge and which is shared in liquid recovery from the plurality of nozzles; and a lead electrode electrically coupled to a pressure generator causing a pressure of the pressure chamber to vary, wherein a conduction unit which is fixed to the lead electrode and which supplies a signal to the pressure generator through the lead electrode is located between the shared supply path and the shared recovery path in a plan view from a lamination direction in which the nozzle plate and the flow path formation substrate are laminated.

14. The liquid ejecting head according to claim 13, wherein a position where the conduction unit is located does not overlap with the shared supply path and the shared recovery path in the plan view.

15. The liquid ejecting head according to claim 13, wherein the shared supply path, the individual supply path, the individual recovery path, and the shared recovery path are located this order in the plan view.

16. The liquid ejecting head according to claim 13, wherein the shared supply path, the individual supply path, the individual recovery path, and the shared recovery path are located same position in the lamination direction.

17. The liquid ejecting head according to claim 13, wherein the conduction unit is located at a position where the conduction unit overlaps with at least one individual flow path of the individual supply path or the individual recovery path in the plan view.

18. The liquid ejecting head according to claim 13, wherein a position where the conduction unit is located overlaps with one of the individual supply path and the individual recovery path in a plan view and does not overlap with the other of the individual supply path or the individual recovery path in the plan view.

* * * * *